US012342966B2

(12) United States Patent
van Zuijlen

(10) Patent No.: US 12,342,966 B2
(45) Date of Patent: Jul. 1, 2025

(54) OUTDOOR SANITATION SYSTEM INCLUDING AN URINAL UNIT FOR TEMPORARY PLACEMENT AND FREQUENT TRANSPORT

(71) Applicant: DaNiFé B.V., Zoetermeer (NL)

(72) Inventor: Johan van Zuijlen, Reeuwijk (NL)

(73) Assignee: DaNiFe B.V., Zoetermeer (NL)

( * ) Notice: Subject to any disclaimer, the term of this patent is extended or adjusted under 35 U.S.C. 154(b) by 523 days.

(21) Appl. No.: 17/779,180

(22) PCT Filed: Nov. 27, 2020

(86) PCT No.: PCT/EP2020/083707
§ 371 (c)(1),
(2) Date: May 24, 2022

(87) PCT Pub. No.: WO2021/105409
PCT Pub. Date: Jun. 3, 2021

(65) Prior Publication Data

US 2023/0045671 A1 Feb. 9, 2023

(30) Foreign Application Priority Data

Nov. 29, 2019 (NL) ..... 2024339
Nov. 29, 2019 (NL) ..... 2024340

(51) Int. Cl.
*A47K 11/12* (2006.01)
*E04H 1/12* (2006.01)

(52) U.S. Cl.
CPC ..... *A47K 11/12* (2013.01); *E04H 1/1216* (2013.01)

(58) Field of Classification Search
CPC ..... A47K 11/12; A47K 11/02; E04H 1/1216
See application file for complete search history.

(56) References Cited

U.S. PATENT DOCUMENTS

D354,122 S 1/1995 Carlier
5,487,240 A * 1/1996 Miller ..... E04H 1/1205 52/79.8
5,560,050 A * 10/1996 Tagg ..... A47K 11/02 4/449

FOREIGN PATENT DOCUMENTS

CN 208251261 U 12/2018
DE 20 2005 006 515 U1 6/2005
(Continued)

OTHER PUBLICATIONS

European Patent Application No. 23205526.9, Office Action, dated Apr. 5, 2024, 11 pages.
(Continued)

*Primary Examiner* — Janie M Loeppke
(74) *Attorney, Agent, or Firm* — Hoffmann & Baron, LLP

(57) ABSTRACT

A urinal unit for temporary providing an urinal including a L-shaped unit body with a base platform which forms a pedestal to stand in front of a urinal and an upstanding wall which forms a privacy separation. At least one urinal is connected to a front side of the upstanding wall. The urinal unit includes a pair of a male and a female lock member to engage with each other in a transport assembly of an assembly of urinal units. In the transport assembly one of the urinal units is stacked in an upside down orientation onto another urinal unit in which the lock members engage with each other to provide stability. The transport assembly may be further compacted by collapsing the upstanding wall of each urinal unit.

19 Claims, 20 Drawing Sheets

(56) References Cited

FOREIGN PATENT DOCUMENTS

| | | | | |
|---|---|---|---|---|
| EP | 0 313 673 | A1 | 5/1989 | |
| WO | 2015/033007 | A1 | 3/2015 | |
| WO | 2017/103839 | A1 | 6/2017 | |
| WO | WO-2017149454 | A1 * | 9/2017 | ..... A47K 3/32 |
| WO | WO-2019137592 | A1 * | 7/2019 | ..... E04H 1/1216 |

OTHER PUBLICATIONS

Certified Extract From the Register of Community Designs, Registration No. 003416692-0001, Dec. 10, 2016, 3 pages.

* cited by examiner

DETAIL XIX

OUTDOOR SANITATION SYSTEM INCLUDING AN URINAL UNIT FOR TEMPORARY PLACEMENT AND FREQUENT TRANSPORT

CROSS-REFERENCE TO RELATED APPLICATIONS

This application is the National Stage of International Application No. PCT/EP2020/083707, filed Nov. 27, 2020, which claims the benefit of Netherlands Application Nos. 2024339, filed Nov. 29, 2019, and U.S. Pat. No. 2,024,340, filed Nov. 29, 2019, the contents of all of which are incorporated by reference herein.

FIELD OF THE INVENTION

In general, the present invention relates to a sanitation system, an urinal unit, method and/or use for transporting a plurality of such items in a stable transport assembly.

In a first aspect, the present invention relates to an urinal unit and a method for transporting a plurality of such urinal units. The urinal unit has a robust configuration which is suitable for frequent transport and use in a public environment. The urinal unit is suitable for a temporary use in an environment where sanitary facilities are limited available, e.g. at city centres, seasonal recreation terrains like a camping or marina, parking place or construction site. In particular, the urinal unit is suitable to be used at an outdoor terrain as a sanitary facility for a large crowd of people during an amusement event, like a music festival or sports event, like a city marathon.

BACKGROUND OF THE INVENTION

A urinal unit which provides four urinals is known from a publication of a design registration with European design number 003416692-0001. This urinal unit is moulded. The urinal unit has a cylindrical bottom and top portion which are connectable to each other. The top portion provides four urinals. In use, multiple persons can stand around the urinal unit.

A problem to this known urinal unit is its high product-volume. The urinal unit is relative bulky. As the urinal unit is only used for a short time during an event, the plurality of urinal units have to be frequently transported to another location. By nesting multiple bottom and top portions of these urinal units, a required transport volume may be minimised.

DE202005006515U1 discloses an L-shaped urinal unit including an upstanding wall and a base platform. In operation, a user stands on the base platform in front of a gutter mounted to the upstanding wall. The base platform is pivotally connected to the upstanding wall which allows a transformation of the urinal unit from an operational configuration to a transport configuration. In the transport configuration, the upstanding wall is collapsed and abutting against the base platform which makes the urinal unit compact.

WO2015/033007 discloses an alternative embodiment of a similar urinal unit in which a telescopic solution is provided to reduce a transport space. A portable urinal is disclosed which is suitable for accommodating various users standing up around. A cylindrical lower vessel is provided which determines a container around which users stand in order to urinate. An upper body closes the lower vessel at the top and is provided with a series of vertical panels to provide privacy partitions. The upper body is telescopically coupled to the lower vessel and able to slide between at least two positions. In a high position, the vertical panels of the upper body provide the users with privacy, and in a gathered-up position, the upper body is lowered into the lower vessel to obtain a transport assembly.

Another urinal unit is known which is adapted to be used by a single person. This urinal unit, also called a PeeOne, is box-shaped. An urinal is positioned against an upstanding rear-wall in between a left and right side wall. At a restroom area, a plurality of such urinal units can be placed in an array to obtain a wall-shaped arrangement of urinals. The left and right side wall of each urinal provide a privacy partition in between the side by side arranged urinals. In the sanitary wall, neighbouring urinals are facing away from each other to provide privacy while facilitating multiple persons.

The box-shape configuration of this urinal unit is beneficial, because the box-shape allows a compact gathering of a plurality of such urinal units to obtain a compact transport assembly. However, in comparison with a multiple person urinal unit, a sanitation system comprising a plurality of such urinal units has a limited storage capacity and servicing of the sanitation system is more time consuming.

Regarding the above-mentioned prior art, it is remarked that any discussion of documents, acts, materials, devices, articles or the like included in the present specification is for the purpose of providing a context for the present invention, and is not to be taken as an admission that any such matters form part of the prior art or were before the priority date of each claim of this application common general knowledge in the field relevant to the present invention.

SUMMARY OF THE INVENTION

The general object of the present invention is to at least partially eliminate the above mentioned drawbacks and/or to provide a usable alternative. More specific it is an object of the invention to provide a urinal unit, in particular a multiple person urinal unit, which can be arranged in a transport assembly in a compact configuration.

According to the invention, this object is achieved by a urinal unit according to the present invention.

According to the invention, a urinal unit is provided for temporary providing at least one urinal at a certain place. By installing the urinal unit, a temporary sanitary facility is provided. Typical places to which the urinal units are transported are outside terrains, like at a festival or a city event.

The urinal unit comprises a L-shaped unit body. The unit body comprises a base platform at a bottom region of the unit body. The base platform forms a pedestal for a user to stand in front of a urinal. The unit body has an upstanding wall at a back region of the unit body. The upstanding wall forms a privacy separation from the outdoor environment. The upstanding wall and base platform together form the L-shape of the unit body. The unit body further comprises at least one urinal connected to a front side of the upstanding wall.

The urinal unit further comprises a pair of a male and a female lock member. The lock members serve to interconnect stacked urinal units. The lock members are complementary shaped to each other to engage with each other in a transport assembly of a plurality of urinal units. In the transport assembly, one of the urinal units is stacked in an upside down orientation to another urinal unit. In the transport assembly of urinal units, the male and female lock members of the stacked urinal units engage with each other.

The urinal unit according to the invention may provide several benefits. A major benefit of a first facet of the invention is that the L-shape of the unit body allows a compact stacking of at least two urinal units, wherein one of the urinal units is placed upside down. The presence of the pair of lock members according to a second facet of the invention provides stability to the stacked urinal units without necessitating additional separately provided fasteners, like tensioning straps. Preferably, the pair of lock members is integrally formed with the unit body by a moulding process, in particular by a rotation moulding process, or formed by items which are non-removable from the unit body, like a U-shaped non-releasable connector as will be further detailed hereafter. Due to their permanent attachment to the unit body or incorporation in the unit body, these lock members are always available to a user to fasten stacked urinal units. A user always has the lock members at hand in any situation to fasten the transport assembly.

In an embodiment of the urinal unit according to the invention, the male lock member is formed by a protrusion, and the female lock member is complementary formed by a recess. Preferably, one of the male or female lock member is positioned on top of the upstanding wall, wherein the complementary other female are male lock member is positioned at a top surface of the base platform, such that said male and female lock members engage to each other when the first urinal unit is placed upside down on top of the second urinal unit. The protrusion and recess are directed in height direction of the unit body, such that the protrusion is received in the recess when lowering of the upside down oriented urinal unit onto the upstanding urinal unit. Herewith, the recess is configured for receiving the protrusion to obtain the transport assembly of the urinal units which prevents a relative movement in a lateral direction. The stacked urinal unit cannot move in a horizontal plane which provides stability to the transport assembly.

In an embodiment of the urinal unit according to the invention, one of the male and female lock members is positioned on a top surface of the upstanding wall, and wherein the complementary other female or male lock member is positioned on a top surface of the base platform, such that said male and female lock members engage to each other when the first urinal unit is placed upside down on top of the second urinal unit. Preferably, the lock members are positioned at a distance from each other on top of the upstanding wall, in particular adjacent an upper corner of the upstanding wall. In comparison with centrally positioned lock members, the spaced apart lock members advantageously contribute to an increase in stability of stacked urinal units.

In an embodiment of the urinal unit according to the invention, the unit body comprises at least two urinals positioned at a front side of the upstanding wall. A wall portion is provided in between each urinal. The wall portion forms a privacy partition. Preferably, the unit body has only two urinals in which the privacy partition is positioned in between the urinals in a middle region of the unit body. The wall portion extends above each urinal for shielding each urinal. In particular, the wall portion may be provided with a removable shield panel as an accessory to further increase privacy. The shield panel is mountable on top of the wall portion to provide a first and second urinal compartment.

In an embodiment of the urinal unit according to the invention, both the male and female lock member are positioned on top of the privacy partition in between two urinals. Both the male and female lock member are positioned on a lower portion end face of the privacy partition. Advantageously, the lock members may also be used to attach the shield panel.

In an embodiment of the urinal unit according to the invention, the male lock member is a separate item. Preferably, the male lock member is an elongated pin-shaped item, and the female lock member is formed by a hole in the unit body. In particular, the male lock member has a pin body with a rectangular, in particular square cross-section. The pin-shaped item may be inserted into a male hole of the unit body to form and position the male lock member in correspondence with the hole of the female lock member.

In a further embodiment of the urinal unit according to the invention, the pin-shaped lock member is axially movable connected to the unit body. Preferably, the lock member is movable under gravity. The lock member can be placed in a sunken or protruding position by orienting the unit body in an upstanding or upside down orientation. Owing to gravity, the lock member sinks down into or protrudes from the unit body. Advantageously, the axial movable lock member forms a male lock member when needed. It is a benefit that the male lock member when positioned at the base platform is available in the upside down orientation of the urinal unit, but forms no disturbing element during normal use of the urinal unit.

In a further embodiment of the urinal unit according to the invention, the pin-shaped lock member is non-releasable connected to the unit body. Regarding the normal use of the urinal unit, the lock member is permanently connected to the unit body, such that the lock member cannot be loosened during transport of the unit body. Without intentional demounting components, the lock member cannot be removed from the unit body. As illustrated in the detailed description, the lock member may e.g. be assembled out of two lock member parts which assembled parts form an intermediate narrowed section in between two enlarged end portions in which the end portions are in a form closed manner mounted to the unit body.

In an embodiment of the urinal unit according to the invention, the upstanding wall has an upstanding wall upper portion and an upstanding wall lower portion, wherein the upstanding wall upper portion can be lowered relative to the upstanding wall lower portion to obtain a compact configuration. In the compact configuration, the urinal unit is in a transport state. When the upstanding wall upper portion is in a raised position, the urinal unit is in a use state. In particular, the upstanding wall upper portion is slidable with respect to the upstanding wall lower portion. The upstanding wall lower portion may at least partially enclose the upstanding wall upper portion to obtain the slidable connection. Preferably, the upstanding wall upper portion is telescopically connected to the upstanding wall lower portion. The upstanding wall lower portion may the hollow and have an inner space for receiving the upstanding wall upper portion. According to the first facet of the invention, any lock member may be superfluous as the compact configuration of the urinal unit contributes to stability in transport. According to the second facet of the invention, a presence of a pair of lock members may further increase stability in transport. The pair of lock members may be positioned at a top surface of the upstanding wall upper portion and the base platform top surface. In a variant, the pair of lock members may be positioned at a lower portion end face of a privacy partition formed by a wall portion in between two urinals.

In an embodiment of the urinal unit according to the invention, the transport assembly of urinal units is a 2-unit assembly. Each urinal unit has a L-shaped unit body. The 2-unit assembly is formed by a first and second urinal unit in which the second urinal unit is placed in an upside down orientation onto the first urinal unit. The second urinal unit is stacked onto the first urinal unit. Advantageously, the 2-unit assembly forms a very compact configuration which minimises dead spaces when transporting the urinal units on a trailer floor to another location.

In another embodiment of the urinal unit according to the invention the transport assembly of urinal units is a 4-unit assembly. Each urinal unit has a L-shaped unit body. The 4-unit assembly is formed by a first, second, third and fourth urinal unit. The first and second urinal unit are placed opposite each other in which the urinals are facing each other. The first and second urinal unit are positioned opposite each other in mirror symmetry. In the 4-unit assembly, the third and fourth urinal units are stacked onto the first and second urinal units in an upside down orientation. Also the third and fourth urinal unit are positioned opposite each other in mirror symmetry. Advantageously, the 4-unit assembly forms a very compact configuration which minimises dead spaces when transporting the urinal units on a trailer floor to another location.

In an embodiment of the urinal unit for forming a 4-unit transport assembly according to the invention, each urinal unit comprises an upstanding wall with chamfered side edges. The chamfered side edges extend in height direction across a whole length of the upstanding wall. The upstanding wall has a width substantially equal to the width of the base platform. When stacking urinal unit in an upside down orientation onto two opposite positioned urinal units, the chamfered side edges guide the urinal unit during the lowering movement. Advantageously, in the transport assembly, the chamfered side edges of the upstanding walls contribute to a lateral blockage of the urinal units. The chamfered side edges beneficially allow a close side-by-side arrangement of the upstanding walls of neighbouring urinal units. Additionally, In a normal use of the urinal units on location, the upstanding walls of the side by side positioned urinal units may form a substantially closed wall without undesired openings in between each upstanding wall.

In an embodiment of the urinal unit according to the invention, the urinal unit further comprises a connector for connecting adjacently positioned urinal units. Preferably, the connector is an item which is positioned at a corner of the base platform of the unit body. Preferably, the connector is a U-shaped item in which the connector has a connector body, in particular a plate-shaped connector body, including a first and second connector member. Preferably, the first and second connector member are pin-shaped members. Preferably, at least one of the connector members has a circular cross-section. Advantageously, the connector is usable to provide an additional lockage to urinal units in the transport assembly in addition to a pair of lock members which are incorporated in the unit body. In particular, the connector may contribute to fastening a bottom region of a transport assembly of four urinal units, when the pair of lock members are situated at a top region of the transport assembly.

In a further embodiment of the urinal unit according to the invention, the second connector member is non-releasable, liftable and pivotable connected to the unit body, in particular to a base platform of a urinal unit. Non-releasable means that in normal use, the connector is permanently, non-removable connected to the unit body. This is beneficial to prevent loosening the connector in handling the urinal unit. Without releasing the connector from the unit body, the connector can be lifted to detach the first connector member from a hole of a first urinal unit and subsequently rotate the first connector member to a hole of a second urinal unit, after which the connector is lowered to introduce the first connector member into the hole of the second urinal unit. Herewith, adjacent positioned urinal units can be easily connected while keeping the connector connected to one of the urinal units to prevent loosening of the connector. Advantageously, the pin-shaped member of the non-releasable connector may form a male lock member of the pair of lock members.

Further, the invention relates to a method for transporting a plurality of urinal units. In transporting the urinal units, the urinal units are placed on a trailer floor. A trailer floor area is limited and may accommodate only a limited number of urinal units.

In a step of the method, at least two urinal units according to the invention are provided. By using an embodiment of the urinal unit according to the invention, advantageously, the urinal units can be stacked in a very compact manner. A transport assembly of combined urinal units is block-shaped which minimises dead spaces in between the urinal units on the trailer floor. In the transport assembly, a first urinal unit is oriented in its standard use position, and a second urinal unit is oriented in an upside down position. In the method according to the invention, the second urinal unit is stacked onto the first urinal unit to obtain the transport assembly of said urinal units. The transport assembly of the at least first and second urinal unit can be build or placed as a whole on the trailer floor.

In an embodiment of the method according to the invention, the method comprises a step of assembling a 2-unit transport assembly, wherein two urinal units are combined. One urinal unit is placed in an upside down orientation onto another urinal unit.

In another embodiment of the method according to the invention, the method comprises a step of assembling a 4-unit transport assembly, wherein four urinal units are combined. Two urinal units are placed in an upside down orientation onto two other urinal units.

According to a first facet of the invention, the invention provides a urinal unit for temporary providing a sanitary facility. Preferably, the urinal unit is made of plastic, in particular manufactured by moulding, more in particular by rotational moulding. According to the first facet which is independent of other facets, aspects, and features of the invention, the urinal unit comprises a L-shaped unit body. A base platform and an upstanding wall together form the L-shape of the unit body. In particular, the base platform and the upstanding wall are a one piece moulded item. More in particular, the item is a solid item in which the upstanding wall is immovable with respect to the base platform. The upstanding wall forms a privacy separation. The upstanding wall is positioned at a back region of the unit body. At least one urinal is connected to a front side of the upstanding wall. The base platform is positioned at a bottom region of the unit body. The base platform forms a pedestal for a user to stand in front of the urinal. Advantageously, a combination of two or four L-shaped unit bodies may provide a compact box-shaped transport assembly. Further embodiments of the L-shaped unit body are described above and detailed in the description hereafter.

Thus, an urinal unit is provided for temporary providing an urinal comprising a L-shaped unit body. The L-shape is formed by a base platform which forms a pedestal to stand in front of a urinal and an upstanding wall which forms a privacy separation. At least one urinal is connected to a front side of the upstanding wall. The urinal unit preferably comprises a pair of a male and a female lock member to engage with each other in a transport assembly of an assembly of urinal units. In the transport assembly one of the urinal units is stacked in an upside down orientation onto another urinal unit in which the lock members engage with each other to provide stability. The transport assembly may be further compacted by reducing a height of the upstanding wall of each urinal unit, in particular by a collapsing of the upstanding wall.

According to an independent second facet of the invention which is independent of the first facet and other mentioned features, aspects and facets, the invention provides a urinal unit which comprises a pair of a male and a female lock member which are complementary shaped to each other to engage with each other in a transport assembly of a plurality of urinal units. In the transport assembly preferably one of the urinal units is stacked in an upside down orientation onto another urinal unit in which the male and female lock members of the stacked urinal units engage with each other to fasten the transport assembly. Advantageously, fastening the transport assembly by the pair of lock members provided by each unit body, preferably incorporated or non-releasable connected to the unit bodies, may provide fasteners which are always available to a user. The fasteners are always at hand and cannot be loosened. Further embodiments of the lock member are described above and detailed in the description hereafter.

According to another independent third facet of the invention, the invention provides a connector for connecting a combination of urinal units, wherein the connector forms one of a male and a female lock member, and wherein a unit body of each urinal unit includes the other corresponding one of the male and female lock member to form the pair of a male and female lock member for fastening combined urinal units in the transport assembly. Herewith, the unit body is adapted to be used with the complementary connector. Advantageously, the connector provides a quick connect or release item to fasten or release urinal units in the transport assembly. Preferably, the connector is a U-shaped item including a first pin-shaped connector member and a second pin-shaped connector member, wherein each unit body comprises corresponding holes for receiving the pin-shaped members of the connector.

In particular, the third facet is independently defined by an urinal unit for temporary providing an urinal in an environment, wherein the urinal unit comprises a unit body, wherein the unit body comprises

- a base platform at a bottom region of the unit body which base platform forms a pedestal for a user to stand in front of a urinal;
- an upstanding wall which upstanding wall forms a privacy separation from the environment; and
- at least one urinal connected to a front side of the upstanding wall, wherein the urinal unit further comprises a connector, in particular a U-shaped connector, for connecting adjacently positioned urinal units.

In an embodiment according to the third facet, the connector comprises a U-shaped connector body including a first pin-shaped connector member and a second pin-shaped connector member, wherein the second pin-shaped member is longer than the first pin-shaped member and non-releasable connected to the unit body.

Further embodiments of the connector are described above and hereafter in the detailed description, in particular in FIGS. 23 to 32.

According to an independent fourth facet of the invention, the invention provides a method for combining urinal units to obtain a transport assembly. In the method, at least two urinal units are combined in which a second urinal unit is oriented upside down regarding a first urinal unit. Preferably, each urinal unit has a L-shaped body.

P34147

In a second aspect, the invention relates to a sanitation system and a method for transporting such a sanitation system. The sanitation system is adapted for temporary use and frequent transport from one to another location. The sanitation system is suitable for a temporary use in an environment where sanitary facilities are limited available, e.g. at city centres, seasonal recreation terrains like a camping or Marina, parking places and construction sites. In particular, the sanitation system is suitable to be used at an outdoor terrain as a sanitary facility for a large crowd of people during an amusement event, e.g. during a music festival or sports event, like a city marathon.

A variety of embodiments of such a sanitation system is known. A widely known configuration of such a urinal unit is a so called Kros urinal unit as disclosed in US Des. 354,122 in the name of Supercross BA. The Kros urinal unit provides multiple urinal compartments on top of a platform. Each urinal compartment is provided with an urinal. The platform has forklift openings at a bottom side which allows the Kros urinal unit to be displaced by a forklift truck. An upstanding wall is provided on top of the platform to provide several privacy separations. The upstanding wall may delimit four or six urinal compartments. The upstanding wall has opposite positioned sidewalls which delimit each urinal compartment in between them. The upstanding wall is moulded as a one-piece item which beneficially provides a robust structure to the urinal unit. The robust structure may prevent damages due to vandalism.

A disadvantage of the Kros urinal unit is that it has a bulky configuration which limits transport efficiency. A plurality of Kros urinal units can be transported by placing the Kros urinal units side by side on a trailer floor.

This drawback of a lack of transport efficiency also applies to other known sanitation systems which have a similar robust, but bulky structure. A similar sanitation system is for example a so called Uriclean which is branded by a company named Satellite. This sanitation system includes a urinal unit which provides three urinal compartments delimited by a one-piece moulded upstanding wall on top of a platform. Another similar sanitation system is for example a so called PEE6 which provides six urinal compartments delimited by a one-piece moulded upstanding wall on top of a platform.

CN208251261 U discloses another sanitation system which includes a urinal unit with a similar appearance including an upstanding wall delimiting urinal compartments on top of a platform. However, this urinal unit has a demountable structure. A top portion comprising four partition walls is demountable from a base portion.

In a few steps, the urinal unit can be assembled at a location by mounting the partition walls on top of the base portion. After use, the urinal unit can be disassembled for transport. A drawback of this sanitation system is that the separate items may be demounted by unauthorised people during use. A robust structure of the urinal unit is desired to prevent vandalism during events. Another drawback is that a demounting of the partition walls may be time-consuming for operators.

A so called a 'Dixi-uri' urinal unit provides a further improvement to such a sanitation system in which a required transport volume is reduced without demounting parts. A transport volume of a urinal unit is obtained by transforming the urinal unit itself. The urinal unit has a telescopically arranged upper portion. To obtain a transport assembly of the urinal unit, the upper portion is lowered into a lower portion of the urinal unit. Herewith, a total height of the urinal unit is reduced to minimise the required transport volume for transporting a plurality of such urinal units. Urinal units can be stacked on each other for transport. A drawback of this urinal unit is that the upper portion may be lowered during use by an unauthorised person. In practise, another drawback is that this urinal unit appears too heavy to be handled by a single person.

In the second aspect, the general object of the present invention is to at least partially eliminate the above mentioned drawback of a lack of transport efficiency and/or to provide a usable alternative. More specific it is an object of the invention to provide a sanitation system including a urinal unit, in particular a multiple compartment urinal unit, which is robust and can be transported in an efficient manner.

Regarding the above-mentioned prior art, it is remarked that any discussion of documents, acts, materials, devices, articles or the like included in the present specification is for the purpose of providing a context for the present invention, and is not to be taken as an admission that any such matters form part of the prior art or were before the priority date of each claim of this application common general knowledge in the field relevant to the present invention.

According to the second aspect of the invention, this object is achieved by a sanitation system according to clause P34147_1 which is provided for temporary providing an urinal.

The sanitation system comprises an urinal unit which has a unit body. The unit body is provided with at least one urinal. Preferably, the at least one urinal is integrally formed with the unit body, e.g. by moulding. The unit body has an upstanding wall including a left and right side wall which are opposite positioned to each other. The opposite positioned sidewalls together delimit an inner space. The inner space forms a urinal compartment for providing privacy to a user while standing in front of the urinal.

The sanitation system further comprises at least one urinal unit accessory. The urinal unit accessory is a releasable item. The urinal unit accessory is removable from the urinal unit to install the urinal unit accessory as a separate item. The urinal unit accessory is a mobile accessory, like a freestanding handwash station or external tank, which can be installed separate from the urinal unit, e.g. aside or opposite the urinal unit.

According to the second aspect of the invention, an improvement is provided in that the urinal unit accessory comprises an accessory body which has an outer shape which fits inside the urinal compartment of the unit body of the urinal unit. The accessory body has a lower portion with an outer shape which corresponds with, in particular substantially equals, an inner shape at a lower region of the urinal compartment. In other words, an outer shape of a lower portion of at least one accessory body is adapted to an inner shape of a lower region of the inner compartment, such that the at least one accessory body closely fits in the inner shape of the inner compartment. In particular, the accessory body has an outer circumferential side which has an outer diameter which is configured to fit in between the sidewalls, in particular in between the urinal, the left sidewall and the right side wall.

A transport assembly of the sanitation system can be obtained by placing the urinal unit accessory in the urinal compartment. Advantageously, the transport assembly of the sanitation system is compact and increases transport efficiency in comparison with a sanitation system in which the urinal unit accessory is transported apart from the urinal unit. In comparison with known sanitation systems dead spaces are reduced in the transport assembly. The at least one urinal unit accessory at least partly fills up such a dead space.

Advantageously, by adapting the outer shape of the lower portion of the urinal unit accessory to the inner shape of the urinal compartment, the urinal unit accessory closely fits in the urinal compartment which prevents undesired large tilts, shifts or clashing during transport.

In addition, a large volume is available for the configuration of the urinal unit accessory. This may for example contribute to a large inner volume of the urinal unit accessory for storing a liquid.

In a preferred embodiment of the urinal unit of the sanitation system according to the second aspect of the invention, the upstanding wall is centrally positioned on top of a platform. Preferably, the upstanding wall is a moulded one-piece item which beneficially provides the robustness to the urinal unit. The upstanding wall forms multiple urinal compartments, e.g. two, three, four, five or six urinal compartments, along an outer circumference of the platform. From a top view, the upstanding wall may be star-shaped, in particular cross-shaped in which the upstanding wall subdivides four urinal compartments. The platform provides a floor area in each urinal compartment allowing a user to stably stand in front of an urinal. Preferably, the platform is rectangular, in particular square, in which each urinal compartment is accessible from a side or corner of the platform.

In an embodiment of the sanitation system according to the second aspect of the invention, the accessory body has a lower portion which has an outer shape which substantially equals to an inner shape of a lower region of the urinal compartment. In other words, the outer shape of the lower portion is inversely shaped to the inner shape of the urinal compartment. Particularly, the accessory body has a footprint which substantially equals a floor area of the inner compartment. Herewith, a single accessory body closely fits in the inner space formed by the urinal compartment.

In an embodiment of the sanitation system according to the second aspect of the invention, multiple urinal unit accessories combined together form an accessory assembly having a lower portion which has an outer shape which substantially equals to an inner shape of a lower region of the urinal compartment. More than one urinal unit accessories can be positioned in an abutting arrangement to obtain the accessory assembly. Preferably, two urinal unit accessories can be combined side by side to form the accessory assembly. The urinal unit accessory may for example be formed as a cable cover accessory, wherein two cable cover accessories can be combined together forming the accessory assembly to closely fit in the urinal compartment. So, according to the second aspect of the invention, an outer shape of a lower portion of the accessory body corresponds with an inner shape at a lower region of the urinal compartment, which means that a single accessory body on its own may have the outer shape which substantially equals the inner shape of the inner compartment or that a combination of at least two accessory bodies together may form the outer shape which substantially equals the inner shape of the inner compartment. Here, the wording substantially implies that practising the concept provided by the second aspect of the invention does not necessitate exact identical shapes of the lower portion of the accessory body and the inner space of the urinal compartment, but that the correspondence in shapes provide a close fit to provide a stable positioning of the at least one urinal unit accessory in the inner compartment of the urinal unit.

In an embodiment of the sanitation system according to the second aspect of the invention, the accessory body has a substantial rectangular cross-section. The accessory body has a substantial rectangular footprint. The rectangular shaped accessory body may be beneficial in building a sanitary wall by placing multiple accessory bodies and urinal units side by side at a rest room area.

In an embodiment of the sanitation system according to the second aspect of the invention, at least one of the urinal compartment and the accessory body comprises at least one lock member for holding the accessory body in the urinal compartment. The at least one lock member is beneficial to prevent the accessory body from falling out of an access opening of the urinal unit and the sanitation system is carried by a fork truck during handling in preparation of a trailer transport. Preferably, the at least one lock member is positioned at a distance above the platform, e.g. at least 50 cm, preferably at the upstanding wall. In comparison with a lock member at a floor area formed by the platform, the lock member at a higher position contributes to prevent a tilt of the urinal unit accessory in the urinal compartment and provides a more stable retaining of the accessory body.

In an embodiment of the sanitation system according to the second aspect of the invention, the at least one lock member is integrally formed with one of the urinal unit or urinal unit accessory. The at least one lock member, preferably a compartment lock member, provides a form closure when the accessory body is placed inside the urinal compartment. Preferably, the accessory body is insertable from above into the urinal compartment of the unit body to obtain the form closure. The accessory body may for example be placed from above behind at least one lock member at the left or right side wall which is the one lock member is positioned close to the access opening of the urinal compartment. The form closure is beneficial in that no separate items, like a tension strap, are required to hold the urinal unit accessory in the urinal compartment of the urinal unit.

In an embodiment of the sanitation system according to the second aspect of the invention, the unit body of the urinal unit comprises a compartment lock member for holding an accessory body in the urinal compartment. Preferably, the compartment lock member is integrally formed with the unit body, in particular integrally formed with the upstanding wall.

In an embodiment of the sanitation system according to the second aspect of the invention, the compartment lock member may be positioned at an urinal. The compartment lock member may be integrally formed with the urinal. In particular, the urinal has a urinal bowl opening which forms the compartment lock member. An accessory lock member is formed as a male locking member to be inserted into the urinal bowl opening.

In an embodiment of the sanitation system according to the second aspect of the invention, the accessory body comprises an accessory lock member for connecting the accessory body in the urinal compartment. Preferably, the accessory lock member is integrally formed with the accessory body. In particular, in the transport assembly of the sanitation unit when the urinal unit accessory is placed inside the urinal compartment, the accessory lock member is adapted to cooperate with the compartment lock member.

In an embodiment of the sanitation system according to the second aspect of the invention, the accessory body is oblong. The accessory body has an outer circumferential side with an outer diameter which is configured to fit in between the left and right side walls, in particular in between the urinal, a first compartment lock member at the left sidewall and a second compartment lock member at the right side wall. The accessory body has a bottom face which is shaped in correspondence with a shape of a floor area in the urinal compartment. The outer circumferential side of the accessory body is preferably provided with an urinal recess for receiving the urinal when the accessory body is placed in the urinal compartment. In particular, the urinal recess extends in a longitudinal direction of the accessory body from the bottom face about a distance at least equal to a height of the urinal in the urinal compartment.

In an embodiment of the sanitation system according to the second aspect of the invention, the compartment lock member is complementary shaped to the accessory lock member. The compartment lock member and the accessory lock member together form a pair of lock members, in particular a pair of a male and a female lock member. The compartment lock member is shaped to cooperate with the accessory lock member. The compartment lock member has a shape which is adapted to engage with a shape of the accessory lock member when the accessory body is placed in the urinal compartment.

In an embodiment of the sanitation system according to the second aspect of the invention, the compartment lock member is a male lock member formed by a protrusion, in particular a lock ridge positioned on the sidewall. The lock ridge is extending in upwards direction along an inner side of the urinal compartment, preferably along an outer edge of the sidewall.

In an embodiment of the sanitation system according to the second aspect of the invention, the compartment lock member is a male lock member formed by a protrusion, in particular a ridge positioned on the urinal. Preferably, the ridge is extending in upwards direction along an outer side of the urinal allowing the urinal unit accessory to be placed from above.

In particular, the accessory lock member is a female lock member formed by lock recess at an outer circumferential side of the accessory body. The lock recess is shaped for receiving the protruding compartment lock member. Advantageously, the shape of the lock members each contributes to an intuitive placement of the urinal unit accessory into the urinal compartment of the urinal unit. The pair of lock members provide a clear indication for a user to intuitively obtain a proper orientation for placement of the urinal unit accessory into the urinal compartment.

According to the second aspect of the invention, a urinal unit accessory may have different appearances. Each urinal unit accessory is configured to function for a different purpose. The urinal unit accessory is of a particular type. A first type of a urinal unit accessory is a urinal unit accessory configured as an external reservoir for a storage of a liquid volume. A second type of a urinal unit accessory is a urinal unit accessory configured as a hand wash station. Other types of urinal unit accessories are conceivable, like a garbage bin, conduit cover for covering a conduit. Preferably, each urinal unit accessory has a moulded accessory body, in particular mould as a one-piece item, in particular made by PE material which provides robustness to the urinal unit accessory which robustness is beneficial in a typical outdoor use of the sanitation system.

In an embodiment of the urinal unit accessory of the sanitation system according to the second aspect of the invention, the urinal unit accessory is an external reservoir which is configured to store a liquid volume originating from the urinal unit. The reservoir is arranged to be placed during use external from the urinal unit. In particular, the reservoir is configured to be placed against a side of the urinal unit or against the side of another urinal unit accessory. Preferably, the reservoir comprises a reservoir coupling member for coupling the reservoir to an adjacent positioned urinal unit accessory or urinal unit. The reservoir has a hollow reservoir body which is fluidly connectable to the urinal unit. Preferably, at least one external reservoir is fluidly connectable to an internal reservoir of the urinal unit to increase a storage capacity of the sanitation system. In particular, the reservoir body is oblong and has a bottom portion which is provided with at least one reservoir port for connecting a drain hose.

In an embodiment of the urinal unit accessory of the sanitation system according to the second aspect of the invention, the urinal unit accessory is a hand wash station for washing hands. The hand wash station comprises a sink on top of a support body. The support body and the sink may be formed as a one-piece item by moulding. The sink may be equipped with a water tap soap or tissue dispenser etc. The hand wash station is configured to be placed during use external from the urinal unit. In particular, the hand wash station is configured to be placed against a side of the urinal unit or against a side of another urinal unit accessory, such that the hand wash station is in a neighbourhood of the urinal unit.

In an embodiment of the urinal unit accessory of the sanitation system according to the second aspect of the invention, the urinal unit accessory is a garbage bin for collecting garbage. The garbage bin comprises a bin.

In an embodiment of the urinal unit accessory of the sanitation system according to the second aspect of the invention, the urinal unit accessory comprises a lower portion incorporating a conduit cover for covering a conduit. The conduit cover at the bottom side of the urinal unit accessory is beneficial in that the urinal unit accessory can be placed adjacent to a unit body and at the same time covering a conduit extending from that unit body. Neighbouring unit bodies may be interconnected by the conduit, wherein the urinal unit accessory in between the unit bodies covers and shields the conduit for getting engaged by the user.

Further, the second aspect of the invention relates to a urinal unit for a sanitation system according to the second aspect of the invention. The urinal unit comprises a unit body including an upstanding wall. The upstanding wall is preferably centrally positioned on top of a platform. The upstanding wall includes at least two sidewalls which face each other to form an inner space in between them. The inner space defines an urinal compartment for a user to stand in front of urinal. Preferably, the upstanding wall defines multiple urinal compartments. In particular, the upstanding wall has a cross-shaped cross-section defining four urinal compartments.

The unit body includes an improvement in that the unit body further comprises at least one compartment lock member for holding an urinal unit accessory inside the urinal compartment in a transport assembly. Preferably, the at least one compartment lock member is non-releasable connected to the unit body, such that the compartment lock member is always available. Such a non-removable compartment lock member is beneficial in obtaining a transport assembly in that no separate locking equipment is required which might get lose. Preferably, the at least one compartment lock member is configured to provide a form closure in a lateral direction when a urinal unit accessory is placed in the urinal compartment. Such a form closure is beneficial because additional steps to fasten a placed urinal unit accessory become superfluous. The at least one compartment lock member is preferably integrally formed with the upstanding wall, e.g. by a lock ridge at an outer of the sidewall to enclose a placed urinal unit accessory. The unit body of the urinal unit may be moulded in which the compartment lock member is moulded together with the upstanding wall.

Further, the second aspect of the invention relates to a urinal unit accessory for a sanitation system according to the second aspect of the invention. In particular, the second aspect of the invention relates to a urinal unit accessory formed as a reservoir for externally from a unit body storing a liquid volume or a hand wash station for a hand wash cleaning external from the unit body. To obtain a stable transport assembly, the urinal unit accessory can be placed in a urinal compartment of a urinal unit. An accessory body of the urinal unit accessory has a lower portion with an outer shape which corresponds with an inner shape of the urinal compartment. A close fit is obtained between the accessory body and the inner compartment to prohibit shifting and tilting of the urinal unit accessory during transport.

Further, the second aspect of the invention relates to a restroom area comprising at least one sanitation system according to the second aspect of the invention. The restroom area may comprise multiple urinal units and multiple urinal unit accessories of different types. Advantageously, the sanitation system can be arranged in such a way that urinal units and urinal unit accessories form a sanitary wall at the restroom area. The sanitary wall comprises an array of urinal units in which at least one urinal unit accessory is positioned in between neighbouring urinal units. Such a sanitary wall is beneficial to increase privacy at the restroom area.

Further, the second aspect of the invention relates to a method for transporting a sanitation system in a transport assembly. The transport method comprises the step of providing a sanitation system according to the second aspect of the invention. The sanitation system comprises an urinal unit having a unit body with at least one urinal compartment and at least one urinal unit accessory having an accessory body which has an outer shape adapted to an inner shape of the urinal compartment. Due to the matching inner and outer shapes of the unit body and the urinal unit accessory, the urinal unit accessory can be placed in the inner compartment in a stable manner in which a possible shifting and tilting of the urinal unit accessory is minimised. Preferably, each urinal compartment is equipped with a compartment lock member, in particular an non-releasable, preferably integrally formed compartment lock member. Each urinal unit accessory may be equipped with an accessory lock member. In a step of the method, the accessory body is placed into the urinal compartment to obtain a transport assembly.

In an embodiment of the method according to the second aspect of the invention, the method comprises the step of locking the urinal unit accessory to the urinal unit. Preferably, the locking is automatically obtained when inserting the urinal unit accessory into the urinal compartment due to an obtaining of a form closure between the urinal unit and the urinal unit accessory.

Embodiments according to the second aspect of the invention are defined by the following clauses:

P34147_1. Sanitation system (9) for temporary providing at least one urinal (13), wherein the sanitation system (9) comprises:

an urinal unit including an unit body (10) with at least one urinal which unit body (10) has an upstanding wall including a left and right sidewall (121, 122) which are opposite positioned to each other and together delimit an inner space (IS) forming a urinal compartment for providing privacy to a user while standing in front of the urinal; and at least one releasable urinal unit accessory (2), e.g. a reservoir (2A) or a hand wash station (2B), to be used as a separate accessory in combination with the urinal unit, wherein the urinal unit accessory (2) comprises an accessory body (20) which has an outer shape which fits inside the urinal compartment of the unit body (10) of the urinal unit, wherein an outer shape of a lower portion (21) of the accessory body (20) is adapted to an inner shape of a lower region of the urinal compartment, such that the urinal unit accessory (2) is placeable in the urinal compartment with a close fit to obtain a stable transport assembly of the sanitation system (9) to prohibit undesired shifts of the at least one urinal unit accessory (2) in the urinal compartment.

P34147_2. Sanitation system (9) according to clause P34147_1, wherein the outer shape of the lower portion of the accessory body (20) substantially equals to the inner shape of the lower region of the urinal compartment.

P34147_3. Sanitation system (9) according to clause P34147_1, wherein at least two urinal unit accessories (2) combined together form an accessory assembly having a lower portion which has an outer shape which substantially equals to an inner shape of a lower region of the urinal compartment.

P34147_4. Sanitation system (9) according to any of the clauses P34147_1-P34147_3, wherein at least one of the urinal compartment and the accessory body (20) comprises at least one lock member (14, 24) for holding the accessory body (20) in the urinal compartment.

P34147_5. Sanitation system (9) according to clause P34147_4, wherein the at least one accessory body (20) fits by a form closure inside the urinal compartment of the unit body (10).

P34147_6. Sanitation system (9) according to any of the clauses P34147_3-P34147_5, wherein the unit body (10) comprises a compartment lock member (14) for holding an accessory body (20) in the urinal compartment.

P34147_7. Sanitation system (9) according to clause P34147_6, wherein the compartment lock member (14) is integrally formed with the unit body (10), and in particular integrally formed with the upstanding wall.

P34147_8. Sanitation system (9) according to clause P34147_7, wherein the compartment lock member (14) is integrally formed with the urinal in which in particular the urinal has a urinal bowl opening (130) which forms the compartment lock member (14).

P34147_9. Sanitation system (9) according to any of the clauses P34147_4-P34147_8, wherein the accessory body (20) comprises an accessory lock member (24) for holding the accessory body (20) in the urinal compartment.

P34147_10. Sanitation system (9) according to clause P34147_9, wherein the accessory lock member (24) is adapted to cooperate with the compartment lock member (14) in the transport assembly of the sanitation system (9) when the urinal unit accessory (2) is placed inside the urinal compartment.

P34147_11. Sanitation system (9) according to clause P34147_9 or P34147_10, wherein the accessory lock member (24) is integrally formed with the accessory body (20).

P34147_12. Sanitation system (9) according to any of the preceding clauses, wherein the accessory body (20) has an outer side which is provided with an urinal recess (23) for receiving the urinal when the accessory body is placed in the urinal compartment.

P34147_13. Sanitation system according to clause P34147_8, wherein the urinal (13) has a urinal bowl opening (130) which forms the compartment lock member (14) and wherein the accessory lock member (24) is formed as a male locking member to be inserted into the urinal bowl opening (130).

P34147_14. Sanitation system (9) according to any of the preceding clauses, wherein the compartment lock member (14) is complementary shaped to the accessory lock member (24), wherein in particular the compartment lock member (14) and the accessory lock member (24) together form a pair of a male and a female locking member.

P34147_15. Sanitation system (9) according to clause P34147_14, wherein the compartment lock member (14) is a male lock member formed by a protrusion, in particular a lock ridge (140), positioned in the urinal compartment, in particular on at least one of the sidewalls (121, 122) or the urinal.

P34147_16. Sanitation system (9) according to clause P34147_14 or P34147_15, wherein the accessory lock member (24) is a female lock member formed by a lock recess (241) at an outer circumferential side of the accessory body (20).

P34147_17. Sanitation system (9) according to any of the preceding clauses, wherein the accessory body (20) is a reservoir (2A) for storing a liquid volume external from the unit body (10), which reservoir has a hollow reservoir body including at least one reservoir port (291) for fluidly connecting the reservoir to the urinal unit.

P34147_18. Sanitation system (9) according to any of the preceding clauses, wherein the accessory body (20) is a hand wash station (2B) for washing hands which hand wash station comprises a sink on top of a support body.

P34147_19. Sanitation system (9) according to any of the preceding clauses, wherein the accessory body (20) is a garbage bin (2C) for collecting garbage which garbage bin comprises a bin, in particular positioned on top of a support body.

P34147_20. Sanitation system (9) according to any of the preceding clauses, wherein the accessory body (20) is a conduit cover for covering a conduit extending from the unit body (10).

P34147_21. Urinal unit for a sanitation system (9) according to any of the clauses P34147_1-P34147_20, wherein the urinal unit comprises a unit body (10) formed by an upstanding wall, which upstanding wall includes at least two each other facing sidewalls (121, 122) forming an inner space (IS) in between said sidewalls which inner space defines an urinal compartment for a user to stand in front of an urinal, wherein the unit body (10) further comprises at least one compartment lock member (14) for holding an urinal unit accessory (2) inside the urinal compartment.

P34147_22. Urinal unit according to clause P34147_21, wherein the at least one compartment lock member (14) is non-releasable connected to the unit body (10).

P34147_23. Urinal unit accessory (2) for a sanitation system (9), in particular a reservoir (2A) or hand wash station (2B), according to any of the clauses P34147_1-P34147_20, wherein the urinal unit accessory (2) comprises an accessory body (20) having a lower portion (21) with an outer shape which corresponds with an inner shape of a urinal compartment of an accompanying urinal unit, such that the accessory body (20) is placeable in the urinal compartment to obtain a transport assembly (TA).

P34147_24. Restroom area comprising at least one sanitation system (9) according to any of the clauses P34147_1-P34147_20.

P34147_25. Restroom area according to clause P34147_24, wherein the restroom area comprises an array of urinal units in which at least one urinal unit accessory (2) is positioned in between neighbouring urinal units, in which at least one urinal unit accessory (2), in particular formed as an external reservoir (2A), is positioned against a side of a urinal unit (1), such that a sanitary wall is formed.

P34147_26. Method for transporting a sanitation system (9) comprising the steps of:

providing a sanitation system according to any of the clauses P34147_1-P34147_20 in which the sanitation system comprises an urinal unit which has a unit body (10) having at least one urinal compartment, preferably provided with a compartment lock member (14), and at least one urinal unit accessory (2) which has an accessory body (20), preferably provided with an accessory lock member (24), wherein an outer shape of the accessory body (20) is adapted to an inner shape of the urinal compartment of the unit body (10), such that a close fit between the urinal unit accessory and the urinal compartment of the unit body is obtainable;

placing the accessory body (20) into the urinal compartment to obtain a transport assembly of the sanitation system.

P34147_27. Method according to clause P34147_26 further comprising a step of:

locking the urinal unit accessory (2) to the urinal unit by at least one of a compartment lock member (14) and an accessory lock member (24).

BRIEF DESCRIPTION OF THE DRAWINGS

The invention will be explained in more detail with reference to the appended drawings. The drawings show practical embodiments according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the clauses above, appended claims, aspects, sub-aspects or facets, in which FIGS. 1-34 show embodiments of the first aspect of the invention and FIGS. 35-51 show embodiments of a second aspect of the invention:

FIG. 1-4 show an embodiment of a stackable urinal unit according to the invention;

FIG. 5 shows an alternative embodiment of the stackable urinal unit in which in comparison with the embodiment of FIG. 1-4, a pair of lock members is seen in a top projection positioned at corner positions of the urinal unit;

FIG. 6-8 show an alternative embodiment of the stackable urinal unit in which a pair of lock members is seen in a top projection positioned in a central region of the urinal unit;

FIG. 9-13 show an embodiment of the stackable urinal unit in which four urinal units are combined to obtain a transport assembly;

FIG. 14-23 show an embodiment of the stackable urinal unit in which an non-releasable axially movable pin is provided to lock urinal units together;

FIG. 24-32 show an U-shaped connector for interconnecting adjacently positioned urinal units; and FIG. 33, 34 show an alternative embodiment of the urinal unit in which an upstanding wall has recessed side edges which provide an engagement between combined urinal units;

FIGS. 35 and 36 show in a perspective view a sanitary wall formed by a sanitation system in which the sanitation system comprises an array of urinal units and a urinal unit accessory placed in between each neighbouring urinal units;

FIG. 37 shows an urinal unit in a perspective view which is when seen from above cross-shaped and providing four urinal compartments;

FIG. 38 shows a urinal unit accessory formed as a reservoir;

FIG. 39 shows a urinal unit accessory formed as a garbage bin;

FIG. 40 shows a urinal unit accessory formed as a hand wash station;

FIG. 41-43 show the urinal unit accessories of FIG. 38-40 which are insertable into the urinal compartments as shown in FIG. 37;

FIG. 44 shows in a cross-sectional view a lockage by a form-closure of the urinal unit accessory in the urinal compartment of the urinal unit;

FIG. 45 shows an enlarged view of the lockage of FIG. 44;

FIG. 46 shows a further embodiment for locking an accessory inside a urinal compartment;

FIG. 47 shows a urinal unit accessory formed a reservoir positioned in between two urinal units;

FIG. 48-49 show a liquid interconnection of the reservoir with both urinal units aside the reservoir; and FIG. 50-51 show a flexible hose for interconnecting the reservoir in fluid communication with the urinal unit.

DETAILED DESCRIPTION OF THE INVENTION

Figure 2:
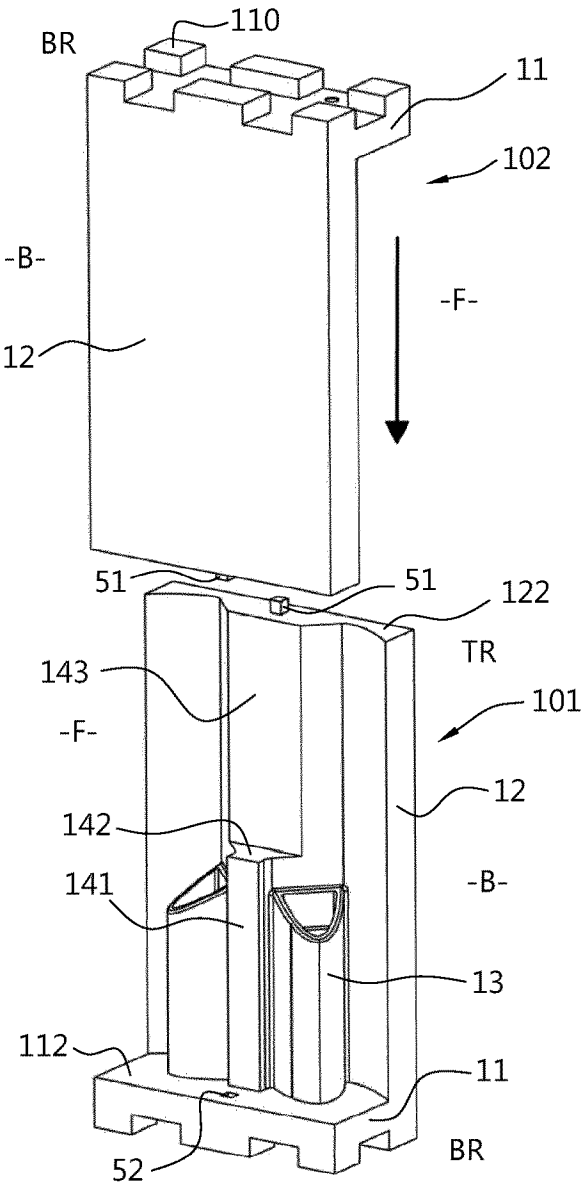

FIGS. 1-34 relate in particular to the first aspect of the invention. Identical reference signs are used in the drawings 1-34 to indicate identical or functionally similar components. Specific features may also be considered apart from the shown embodiment and may be taken into account in a broader context as a delimiting feature, not only for the shown embodiment but as a common feature for all embodiments falling within the scope of the appended claims.

Figure 1:
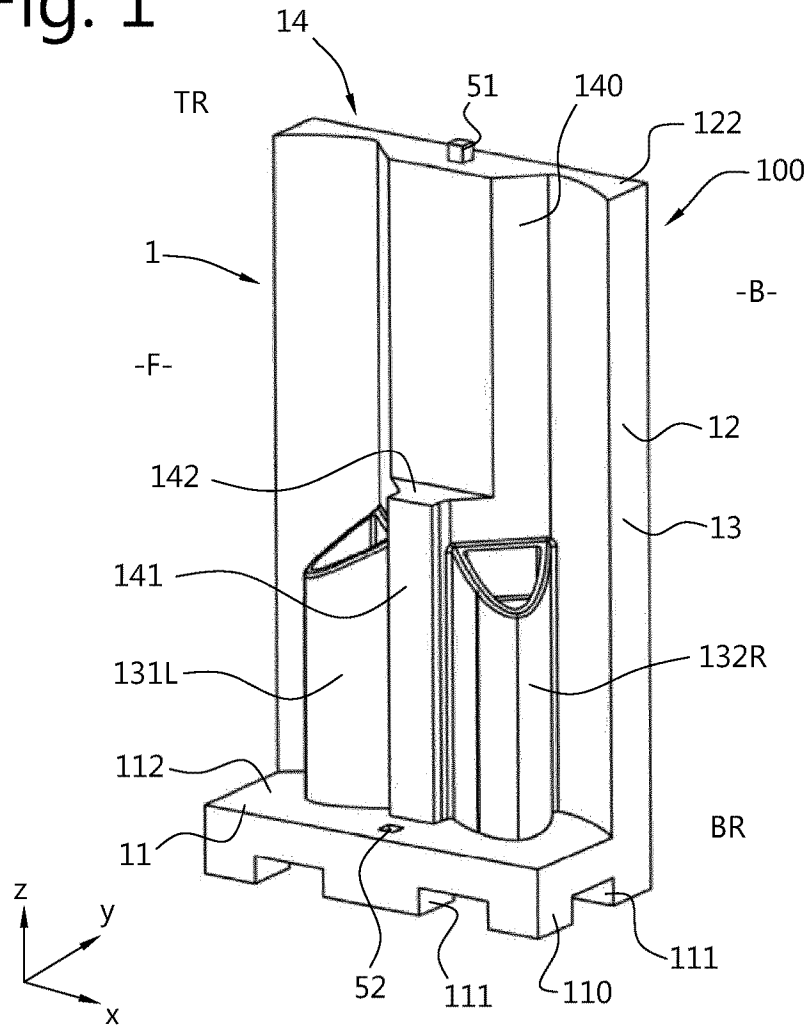

To facilitate comprehension of the description and of the claims the words vertical, horizontal, upside down, down wards etc.—with reference to gravity—are used in a non-limiting way. FIG. 1 shows a coordinate system including a X-, Y-, Z-axis. The Z-axis defines a height or vertical direction. The X- and Y-axis define a horizontal plane, in which the X-direction defines a length direction and the Y-direction defines a width direction. The X- and Z axis define a XZ-plane which is a vertical plane in length direction defining a front F and back B. The Y- and Z-axis define a YZ-plane which is a vertical plane in width direction defining a left L and right R.

FIG. 1 shows in a perspective view an embodiment of a urinal unit 100 according to the invention. The urinal unit is a sanitary unit adapted for outdoor use. The urinal unit is adapted for a temporary placement in an outdoor environment, like at a festival or sports terrain. During an event, a placement of a plurality of such urinal units 100 provides a quick and easy sanitary capacity available for a large crowd of people.

The urinal unit 100 is a one-piece item. The urinal unit is made out of plastic by moulding, in particular by rotation moulding. The urinal unit comprises a L-shaped unit body 1. At a bottom region BR, the unit body comprises a base platform 11. The base platform 11 forms a pedestal for a user to stand in front of a urinal 13. The base platform 11 has an underside which is provided with several supporting feet 110 to support the base platform 11 onto an underground. At least one fork opening 111, in particular two fork openings at a side, are provided in between neighbouring feet 110 to allow a forklift to insert its forks into the fork openings 111 for lifting the urinal unit 100 to place the urinal unit 100 onto a trailer for transport.

The urinal 13 is connected to a front side of an upstanding wall 12. The upstanding wall 12 is positioned at the back region of the unit body 1. The upstanding wall 12 forms a privacy separation in between a front F and a back B of the unit body 1. The privacy separation shields a user from the outdoor environment.

Here, the unit body 1 comprises two urinals 13, a left and right urinal 131, 132. A privacy partition 14 is provided in between the urinals 131, 132. The privacy partition 14 is positioned in a middle region of the unit body 1. The privacy partition 14 has an upper portion 140 and a lower portion 141. The lower portion 141 extends a distance above the urinal 13. The lower portion 141 has a height which is substantially half a height of the upstanding wall 12. The lower portion 141 has an end face 142. The end face 142 delimits the lower portion 141 from the upper portion 140.

Figure 4B:
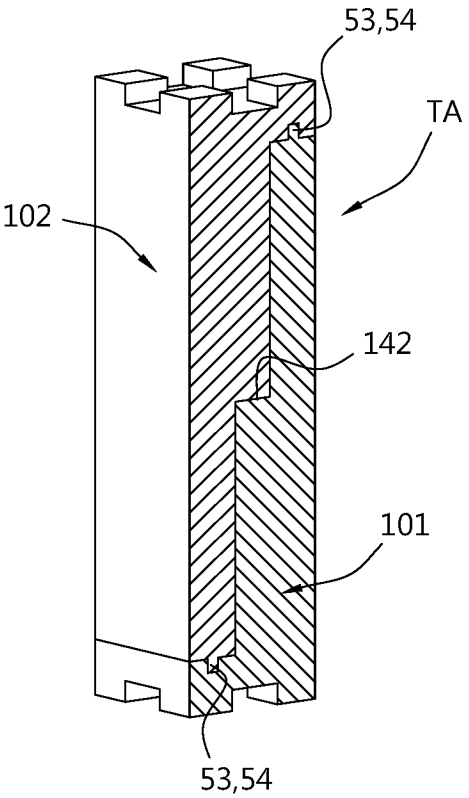
Figure 4A:
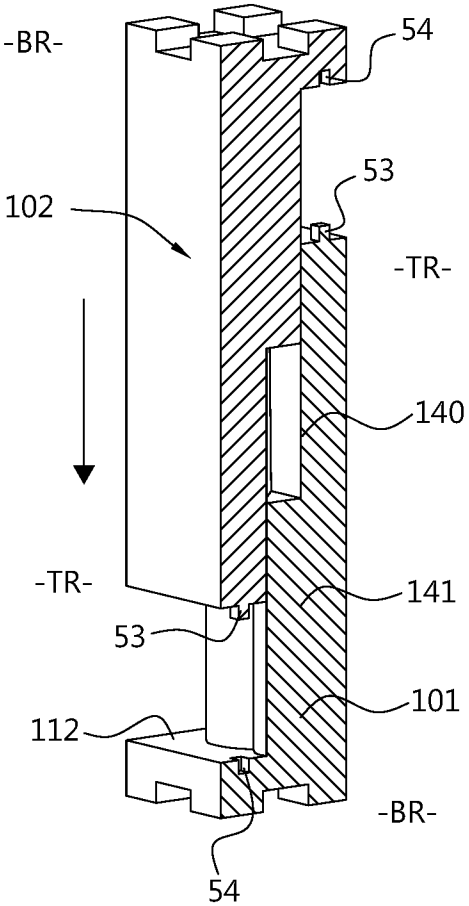
Figure 3:
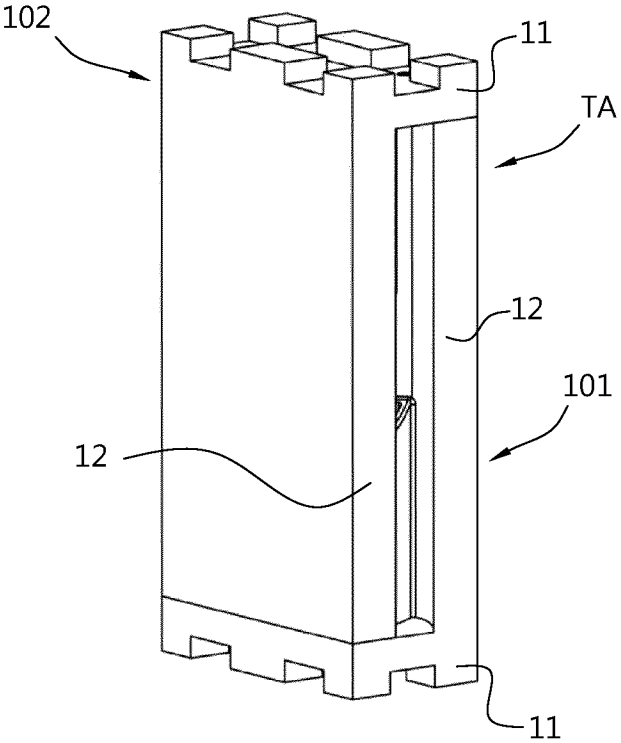
Figure 5:
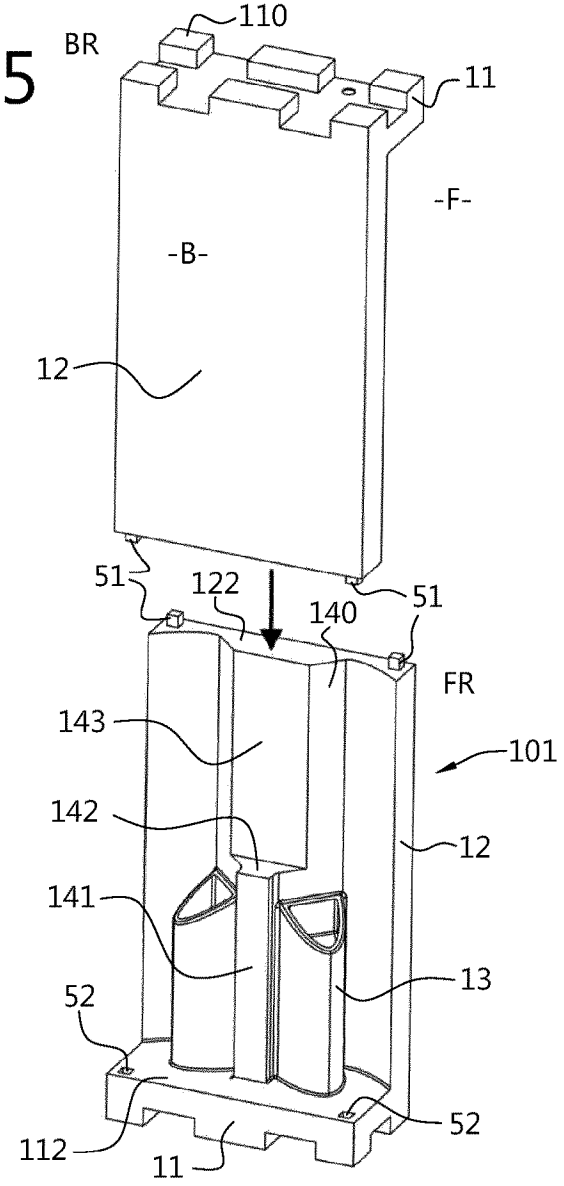

FIG. 2-4 show a stacking of identical urinal units 100 onto each other according to the invention in successive drawings to obtain a transport assembly. FIG. 5 shows a similar stacking of identical urinal units in which embodiment the locking members 5 are disposed at another position.

FIG. 2 shows a first and second urinal unit 101, 102. The first urinal unit 101 is oriented in a normal orientation in which orientation the urinal unit is normally used. In the normal orientation, the base platform 11 of the unit body 1 is placed onto an underground. The second urinal unit 102 is oriented in an upside down orientation to stack the second urinal unit 102 onto the first urinal unit 101.

A pair of lock members 5 is provided to lock the urinal units together. The pair of lock members 5 comprises a male lock member 51 and a female lock member 52. The male and female lock member 51, 52 are complementary shaped to engage to each other. The pair of lock members 5 provide a form closure in a lateral direction, in a horizontal plane. One of the male and female lock member 51, 52 is positioned on a top surface of the upstanding wall 12, and the other complementary lock member is positioned on a top surface of the base platform 11.

FIG. 3 shows the stacked first and second urinal units 101, 102 which stacking forms the transport assembly TA. In the transport assembly TA, the bottom region BR of the second urinal unit 102 fits onto the top region TR of the first urinal unit 101. The top region TR of the second urinal unit 102 fits onto the bottom region BR of the first urinal unit 101.

The first and second urinal units 101, 102 are locked in a lateral direction. The second urinal unit 102 can only be released from the first urinal unit 101 by lifting the second urinal unit 102 in upwards direction. A gravity force keeps the two urinal units stably together.

Herewith, a transport assembly TA is obtained which has a stable and compact configuration of two urinal units 101, 102 which is beneficial in transporting the urinal units. The stacked urinal units can easily be placed onto a trailer floor by a forklift. The box-shaped configuration of the transport assembly allows a close side-by-side arrangement of the units, such that a space efficient gathering of stacked urinal units can be achieved.

As shown in a cross-sectional views in further detail in a left and right sided view in FIG. 4, the male and female members 51, 52 are integrally formed with the unit body 1. The lock members 5 are integral with the unit body 1 and formed during the moulding process, in particular the rotation moulding process. The male member 51 is formed by a protrusion 53. The female member 52 is formed by a recess 54. The recess 54 is complementary shaped to the protrusion 53. The protrusion 53 closely fits into the recess 54. As shown in the left sided view, the upper portion 140 serves as a guidance to align the pair of lock members 5 onto each other. The upper portion 140 has a frontal surface 143. When stacking a first and second urinal unit 101, 102, the frontal surfaces 143 of each urinal unit mate with each other.

As shown in the right sided view of FIG. 4, in the transport assembly TA, the end faces 142 of each urinal unit 101, 102 are mating, in particular in an abutting engagement with each other or closely spaced.

Here, seen in a top projection, in FIG. 1-4, the male and female lock member 51, 52 are positioned in a middle region of the top surfaces of the base platform 11 and the upstanding wall 12. The male and female lock member 51, 52 are centrally positioned on respectively the base platform 11 and the upstanding wall 12. As indicated by the arrow in FIG. 2, when moving the upside down positioned urinal unit 102 in a downward direction (gravity direction), the male and female lock member 51, 52 engage with each other to lock the urinal units 101, 102 to each other.

FIG. 5 shows an alternative embodiment of the urinal unit in which the pair of lock members 5 is arranged double. Instead of a single pair of lock members 5, a first and second pair of lock members 5 is provided. Each pair of lock members 5 is provided at a corner position on the upstanding wall 12 and at a corresponding position on the base platform 11. Advantageously, the double pair of lock members 5 provide a more stable locking in comparison with a single pair of lock members 5 is shown in FIG. 2.

Figure 6:
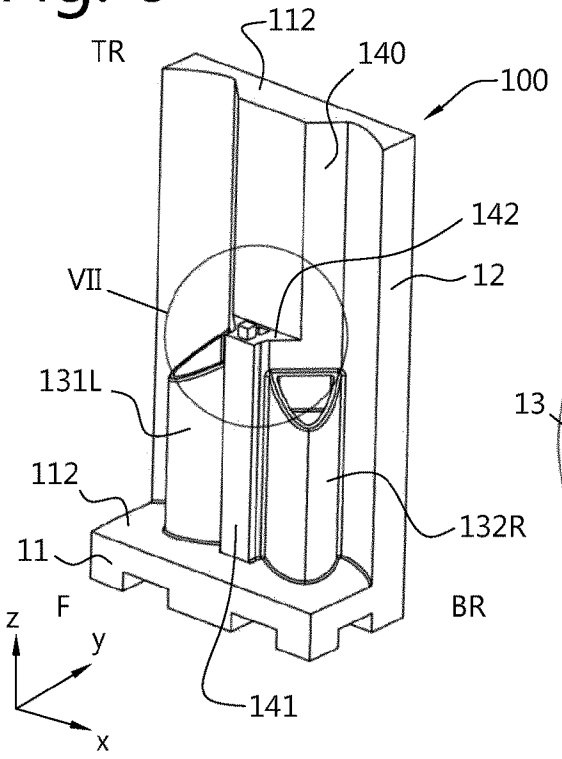
Figure 7:
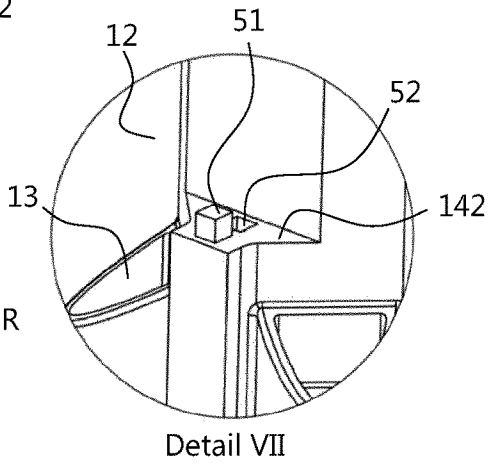

FIG. 6-8 show an alternative embodiment of a urinal unit 100 in which the pair of lock members 5 is disposed at the end face 142 of the privacy partition 14. FIG. 7 shows an enlarged view of the pair of lock members 51, 52. The pair of lock members 5 comprises a male lock member 51 which is positioned aside the female lock member 52 at the end face 142. The male and female lock members 51, 52 are positioned in the vertical YZ plane. It does not matter whether the male or female lock member is positioned at the front or back, the aligned positioning in the vertical YZ plane enables a combination of two identically configured urinal units 101, 102 to obtain a transport assembly TA.

Figure 8B:
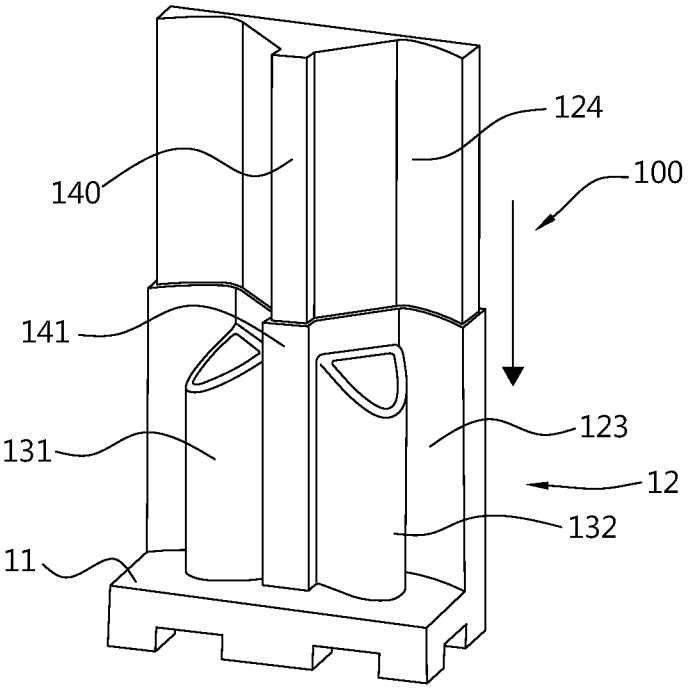
FIG. 8A, 8B-8D show the stackable urinal unit as shown in the FIGS. 6 and 7 respectively provided with a solid or telescopic upstanding wall.
Figure 8A:
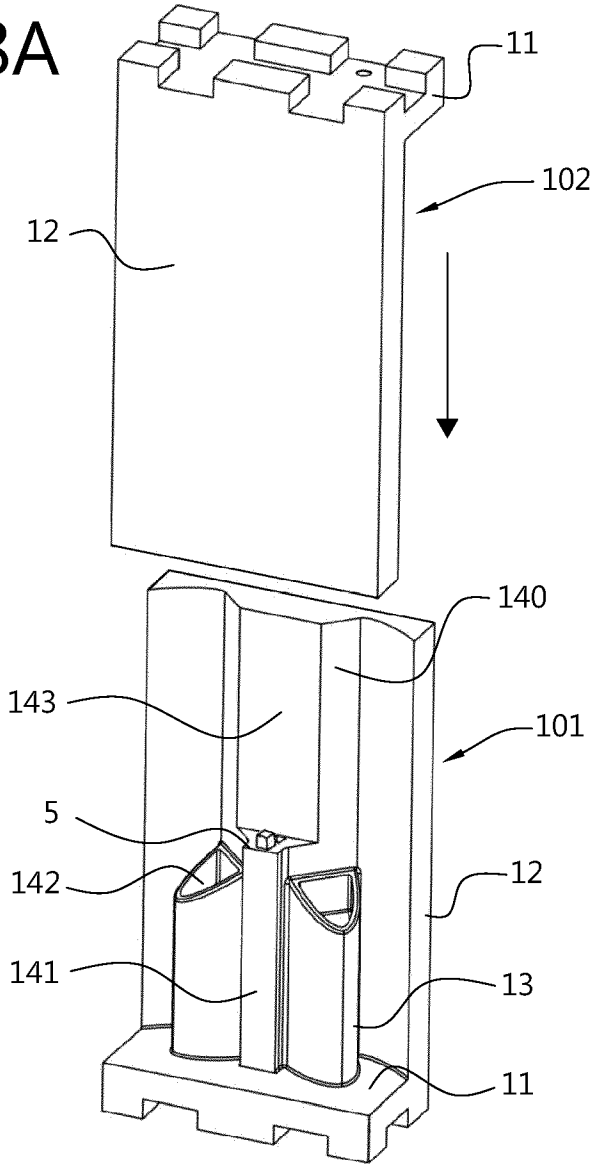

As shown in FIG. 8A, analogous to FIG. 2, to obtain the transport assembly TA, the second urinal unit 102 is oriented upside down and backwards before lowering the second urinal unit 102 onto the first urinal unit 101. The frontal surface 143 of the upper portion is beneficial in aligning the urinal units 101, 102. When lowering the second urinal unit 102, the pair of lock members 5 are mated to lock the urinal units in a horizontal plane.

Figure 8C:
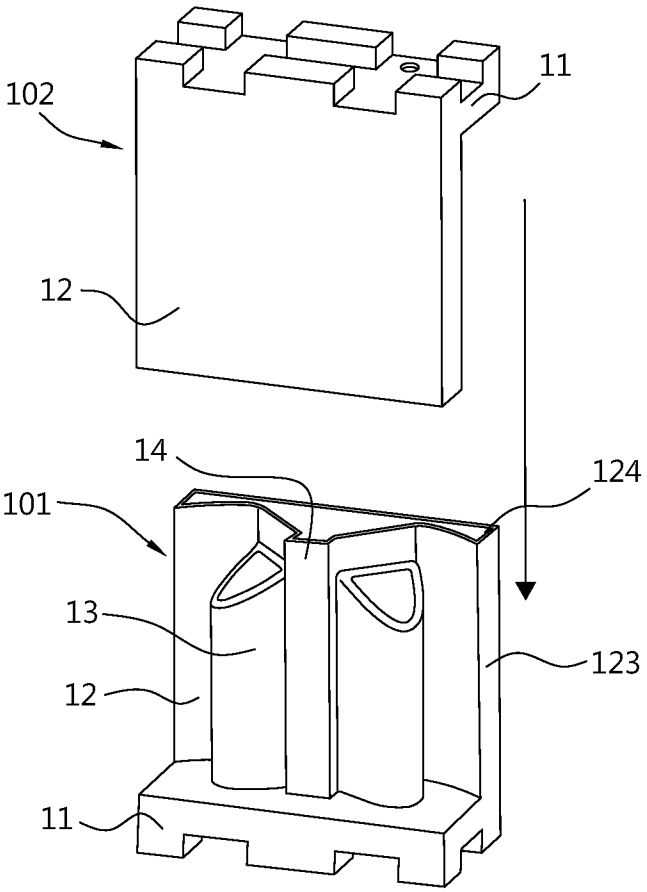
Figure 8D:
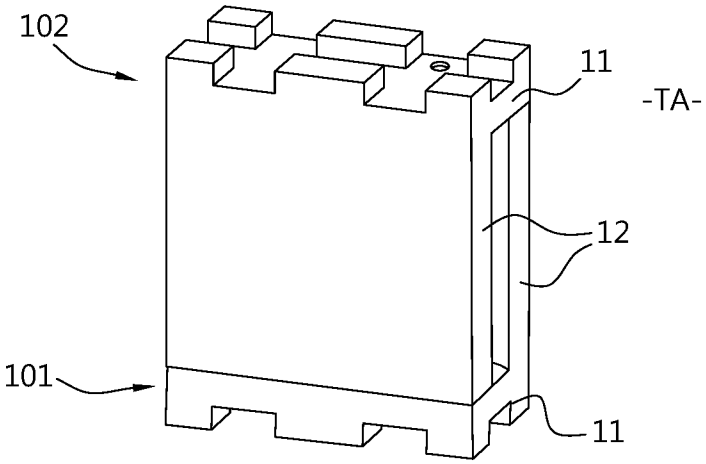

FIG. 8B-8D show an alternative embodiment of the urinal unit 100 according to the invention. The upstanding wall 12 has an upstanding wall lower portion 123 and an upstanding wall upper portion 124. The upstanding wall 12 can be compacted to obtain a transport state. In a raised position of the upstanding wall upper portion 124, the urinal unit 100 is in a use state.

To compact the upstanding wall 12, the upstanding wall upper portion 124 may be removed from upstanding wall lower portion to transport the upstanding wall upper portion 124 is a separate item. Here, advantageously, the upstanding wall upper portion 124 is slidable with respect to the upstanding wall lower portion 123. The upstanding wall upper portion 124 is slidable to a lower position in preparing the urinal unit 100 for transport. The upstanding wall lower portion 123 may slidably engage the upstanding wall upper portion 124, e.g. by engaging side edges of the upstanding wall upper portion 124. Preferably, as shown, the upstanding wall 12 has a telescopic configuration in which the upstanding wall lower portion 123 circumvents the upstanding wall upper portion 124. The upstanding wall upper portion 124 can be lowered into a hollow shaped upstanding wall lower portion 123.

FIG. 8B shows a preparing step before stacking a first and second urinal unit 101, 102 for transport. The telescopically connected upstanding wall upper portion 124 is lowered into the upstanding wall lower portion 123 as indicated by the arrow. Herewith, a height of the urinal unit may be reduced by at least 40%.

FIG. 8C shows a first urinal unit 101 and an upside down oriented second urinal unit 102. The second urinal unit 102 is oriented in a backwards position and can be placed onto the first urinal unit 101 as indicated by the arrow to obtain the transport assembly as shown in FIG. 8D. The shown embodiment in FIG. 8B-8D lacks a pair of lock members. Advantageously, the combination of the first and second L-shaped urinal units 101, 102 transformed to a compact configuration before stacking may provide a stable transport assembly TA in which any lock member may be redundant. A pair of lock members 5 may be provided as for example shown in FIG. 2,5 or 8A at a top surface of the upstanding wall upper portion 124 or at the upstanding wall lower portion 123 to further stabilise the transport assembly.

FIG. 9-13 show an alternative embodiment of the urinal unit 100 according to the invention. Here, the transport assembly TA is obtained by combining four urinal units 100 as shown in FIGS. 10-13. Again, all combined urinal units 100 have the same configuration.

Figure 9:
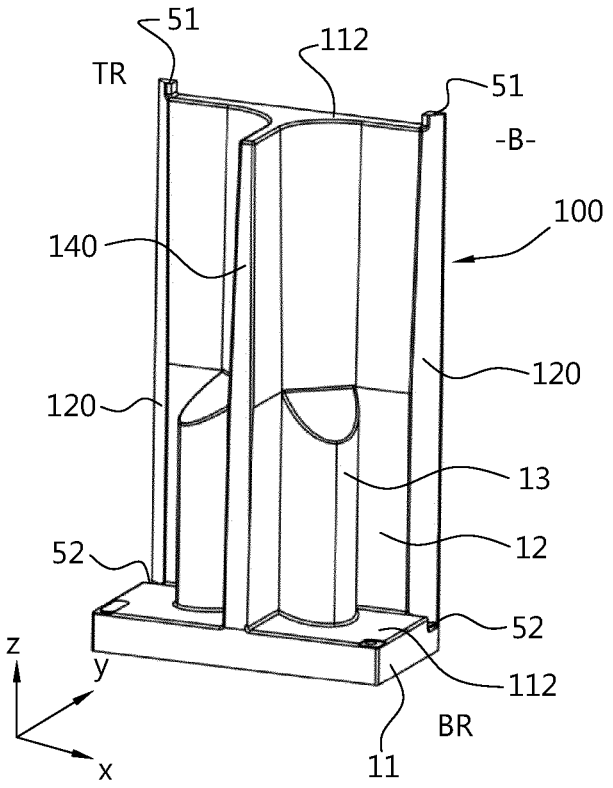

FIG. 9 shows an embodiment of the urinal unit 100 in a perspective view. The embodiment of this urinal unit 100 is similar to the configuration as illustrated in FIGS. 1-8. However, this configuration of the urinal unit 100 is distinguished by the feature of the privacy partition 14 and chamfered side edges 120 of the upstanding wall 12. The privacy partition 14 has no upper and lower portion 140, 141 which are delimited by an end face 142. The privacy partition 14 has a height which continuously extends along a distance which is larger than half a height of the upstanding wall 12. Here, the privacy partition 14 extends from the base platform 11 to a top surface of the upstanding wall 12. The side edges 120 of the upstanding wall 12 are chamfered to allow stacking of four urinal units. The side edges 120 are chamfered about at least 45° along an edge extending in a height direction along a whole height of the upstanding wall 12.

A pair of lock members 5 including a male and female lock member 51, 52 is provided on top of the base platform 11 and the upstanding wall 12. Here, the male and female lock members 51, 52 are positioned at a corner position of respectively the upstanding wall 12 and the base platform 11. One of the lock members 51, 52 is positioned at a corner at a back side of the unit body 1. The lock member is positioned at the intersection of the upstanding wall 12 and the base platform 11. Here, a female lock member 52 is shown at the corner. Alternatively, the unit body 1 may be embodied by a male lock member 51 at this corner.

Figure 10:
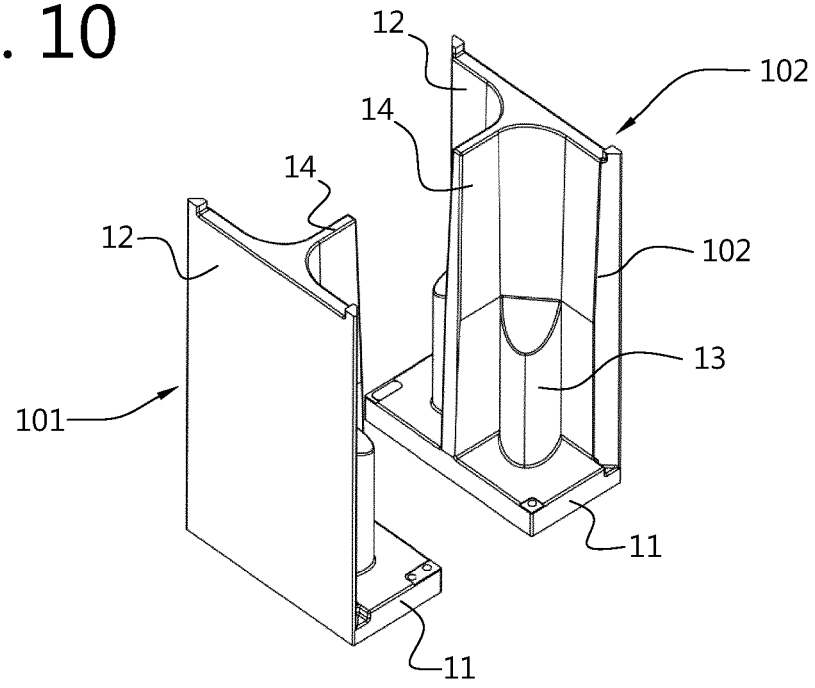

FIG. 10 shows a first step of an embodiment of a method of combining urinal units 100 to obtain a transport assembly TA. In the first step, a first and second urinal unit 101, 102 are positioned opposite each other. The first and second urinal unit 101, 102 are positioned in mirror symmetry. Each frontal surface of each base platform 11 of each urinal unit 101, 102 is mated with another. In the first step, the first and second urinal unit 101, 102 are placed, such that the frontal surface of the base platform 11 of the first urinal unit 101 is facing the frontal surface of the base platform 11 of the second urinal unit 102.

Figure 11:
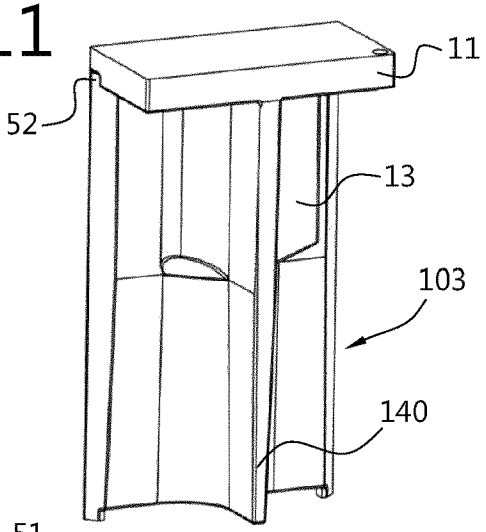

FIG. 11 shows a subsequent step of the embodiment of the method of combining urinal units 100 to obtain the transport assembly TA. A third urinal unit 103 is combined with the positioned first and second urinal units 101, 102. The third urinal unit 103 is oriented upside down. The third urinal unit 103 is right angled oriented with respect to the first and second urinal units 101, 102.

As shown in FIG. 11, after the first step of combining the first and second urinal units 101, 102, a clearance 55 is left between each of the privacy partitions 14. The privacy partition 14 of each unit body 1 is shaped in which a frontal surface of the privacy partition 14 is inclined in height direction. Along its height from the base platform 11, the frontal surface of the privacy partition 14 is slightly extending in a direction towards the upstanding wall 12. The privacy partition 14 has a partition base which has a larger length (in Y direction) than a length of a partition top. The privacy partition 14 of the third urinal unit 103 fits into this clearance 55 when building the transport assembly TA.

Figure 12:
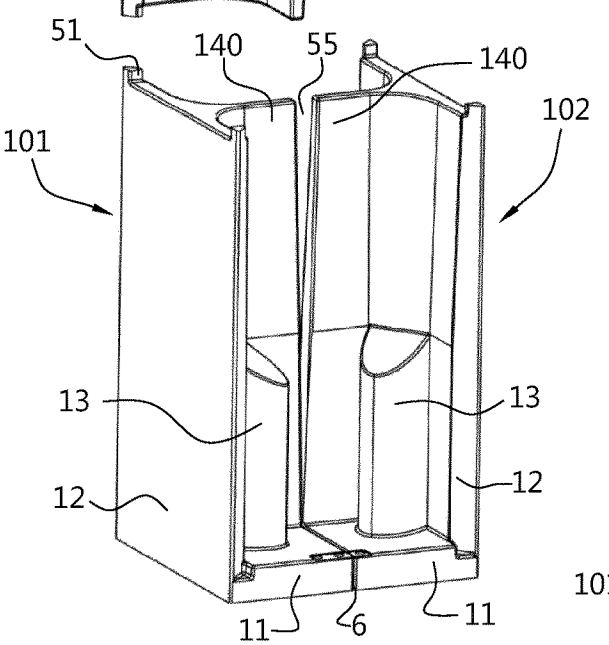
Figure 12:
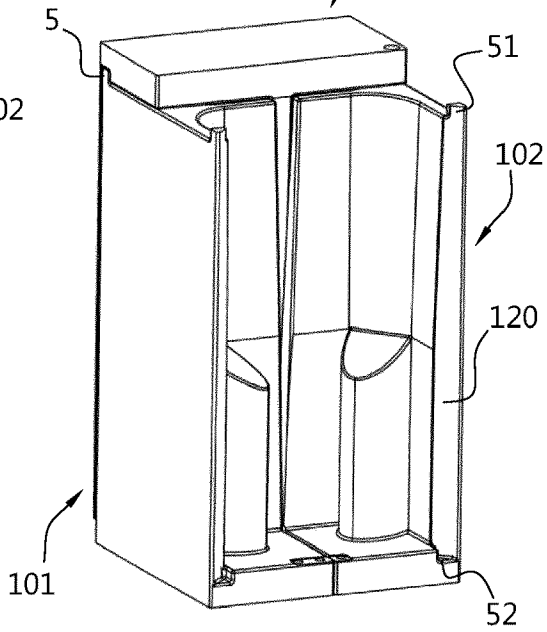

FIG. 12 shows the combined first, second and third urinal units 101, 102 and 103. The third urinal unit 103 fits in between the chamfered side edges 120 of the opposite positioned first and second urinal unit 101, 102. The chamfered side edges serve to align the third urinal unit 103 during placement. The pair of lock members 5 are in engagement. A male lock member 51 of the first urinal unit 101 is in engagement with a female lock member 52 of the third urinal unit 103. In the same way, at an opposite position, a male lock member 51 of the second urinal unit 102 is also engaging the female lock member 52 of the third urinal unit 103.

Figure 13:
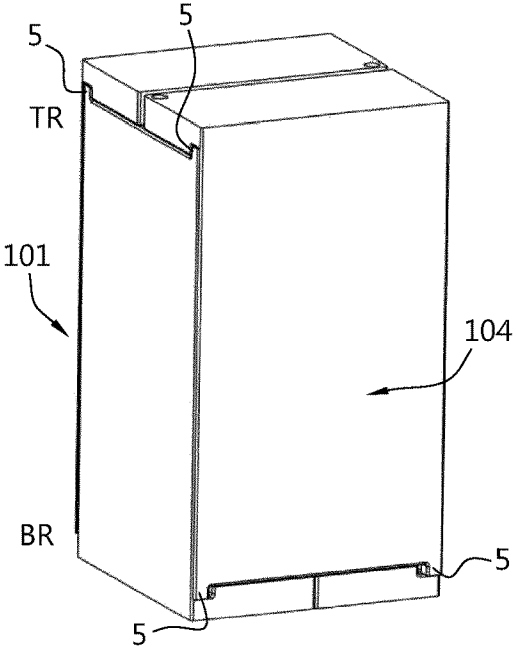

FIG. 13 shows a transport assembly TA of urinal units, in which a fourth urinal unit 104 is placed upside down onto the first and second urinal unit 101, 102 facing the third urinal unit 103. Several pairs of lock members 5 engage to each other. Pairs of lock members 5 are situated at the bottom region BR and the top region TR of the combined urinal units in the transport assembly. The provision of lock members 5 at the bottom and top region of the stacked urinal units prevent an undesired release of a urinal unit. Herewith, a stable and compact configuration is obtained.

Figure 14:
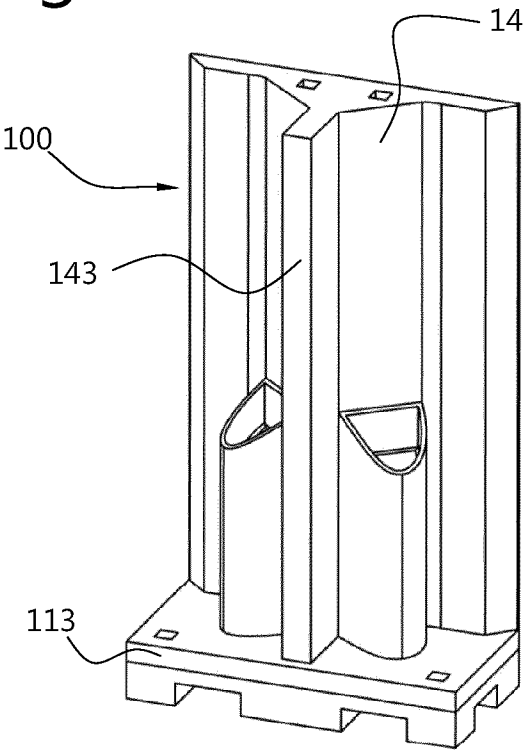

FIG. 14 shows another embodiment of the urinal unit 100 according to the invention. Instead of an inclined privacy partition 14—as shown in FIGS. 9-13, here a straight privacy partition 14 is provided. The frontal surface 143 of the privacy partition 14 is right angled with respect to a top surface of the base platform 11. The frontal surface 143 of the privacy partition 14 is spaced at a distance from the frontal surface of the base platform 11 to provide the clearance 55.

Figure 15:
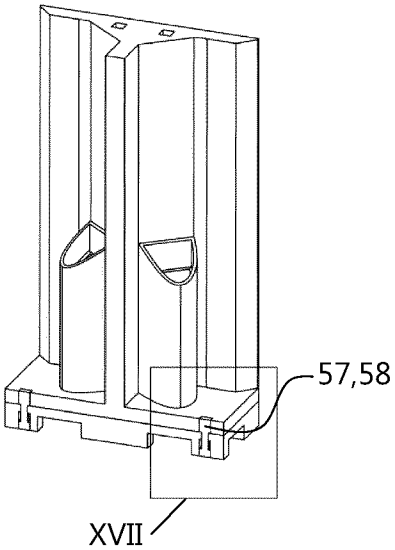
Figure 17:
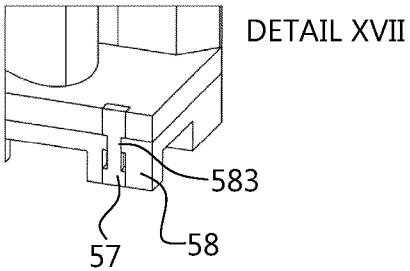
Figure 16:
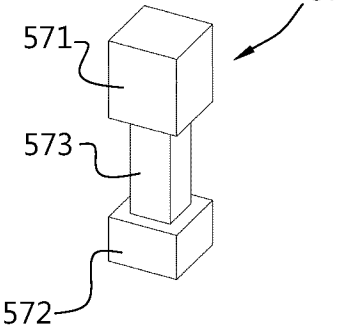

FIG. 15-17 show an alternative embodiment of the pair of lock members 5. The pair of lock members 5 comprise a pin 57, a so called non-releasable pin. In its normal use of the urinal unit, non-releasable means that the pin 57 cannot be taken away from the aperture 58 without demounting components.

FIG. 16 shows the pin 57 in further detail. The pin 57 has an elongated pin body 570. The pin body 570 may have a circular or rectangular, in particular square cross-section. Here, a square cross-section is shown. The pin body 570 has a pin head 571 and a pin base 572. In between the pin head 571 and the pin base 572, the pin body is recessed. The pin body 570 has a narrowed section 573 in between the pin head 571 and the pin base 572. The aperture of the unit body 1 is complementary shaped.

As shown in the enlarged view in FIG. 17, the pin 57 is positioned in the aperture 58. The aperture 58 has a narrowed section 583 which is smaller than the narrowed section 573 of the pin 57 which allows the pin to axially move inside the aperture. The pin 57 is axially movably received in an aperture 58 of the unit body 1, but cannot be removed.

The pin 57 is movable in the axial direction under gravity. The pin 57 has a sunken position in which the pin 57 is sunk in the unit body 1, in particular below the top surface of base platform 11 or below the top surface of the upstanding wall 12. This sunken position is shown in FIG. 17.

Figure 18:
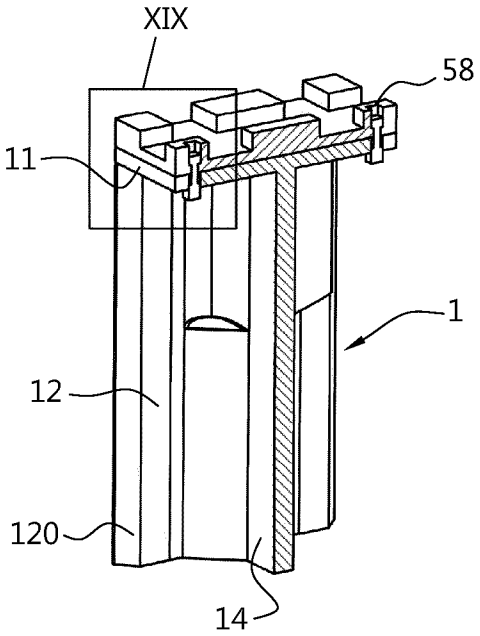
Figure 19:
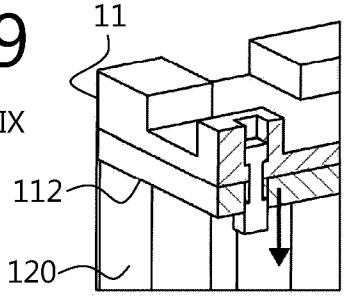

FIG. 18 and the enlarged view of FIG. 19 show that when the unit body 1 is placed upside down, the pin 57 axially moves under gravity (as indicated by the arrow) relative to the unit body 1 to a protruding position. In particular, in the protruding position, the pin 57 protrudes above the top surface 112 of respectively the base platform 11 and the upstanding wall 12.

As shown in the FIGS. 15-19, the pin 57 is preferably positioned in an aperture 58 of the base platform 11. In normal use, the pin 57 is in the sunken position in which the pin head 571 is laying deeper or at most flush with the top surface 112 of the base platform 11. Herewith, the pin head 571 prevents a presence of an open pocket in the base platform which is beneficial in preventing contamination.

Figure 20:
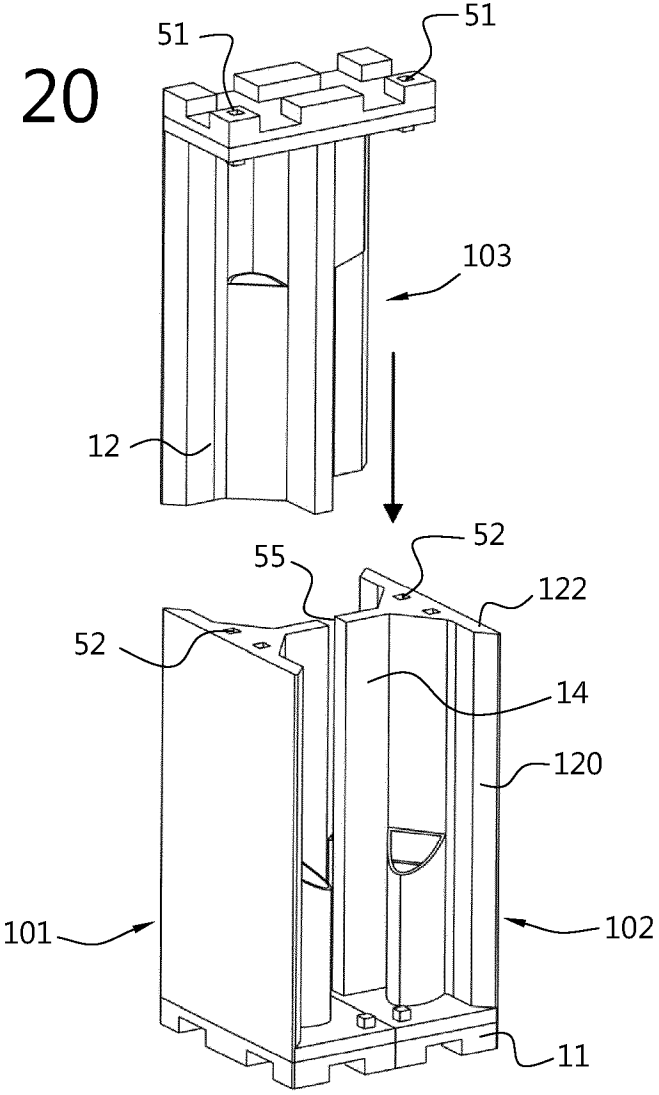
Figure 22:
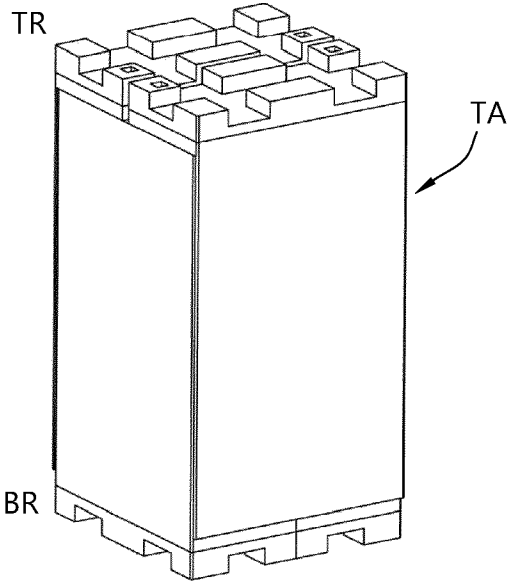
Figure 21:
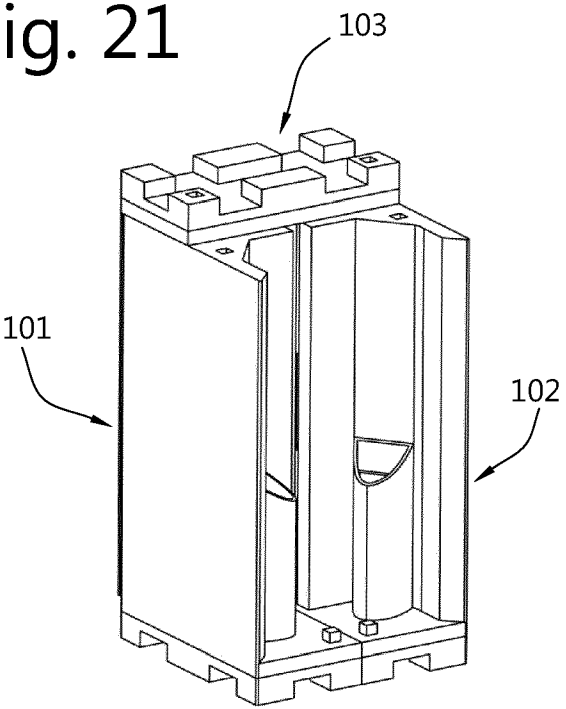

FIGS. 20-22 show a combination of a first, second, third and fourth urinal unit 101, 102, 103 and 104 to obtain a transport assembly TA as shown in FIG. 22. In combining the urinal units, as shown in FIG. 20, the first and second urinal unit 101, 102 are facing each other, and the third urinal unit 103 is placed upside down onto the first and second urinal unit 101, 102. Due to gravity, the pins 57 of the third urinal unit 103 are in the protruded position and form the male lock members 51. Each pin 57 fit into a female lock members 52 formed by a recess at the upstanding wall top surface 122. The placement of the third urinal unit 103 onto the first and second urinal unit is shown in FIG. 21. After placing a fourth urinal unit in a same manner as the third urinal unit on top of the first and second urinal unit, the transport assembly is completed.

Figure 23:
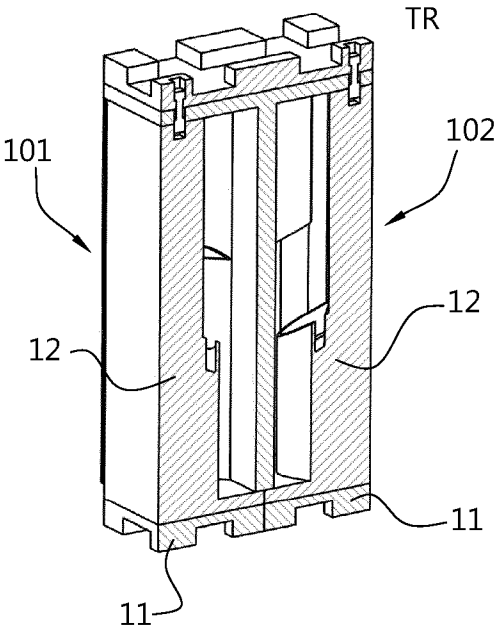

FIG. 23 shows a cross-sectional view of the transport assembly TA in which the pair of lock members 5 is engaging in the top region TR of the transport assembly which provides stability.

Figure 24:
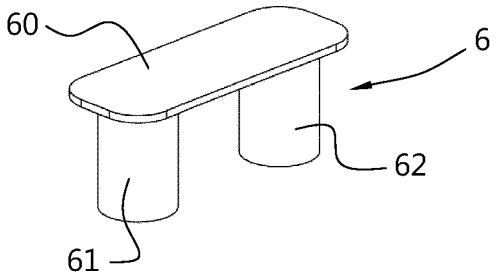
Figure 25:
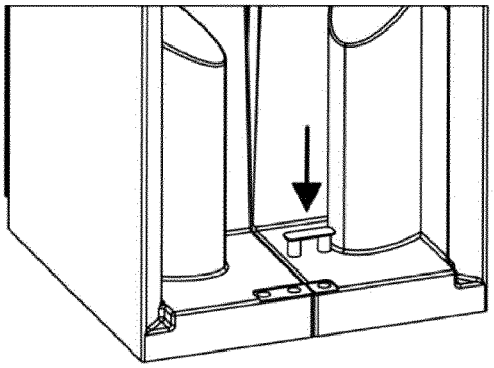
Figure 26:
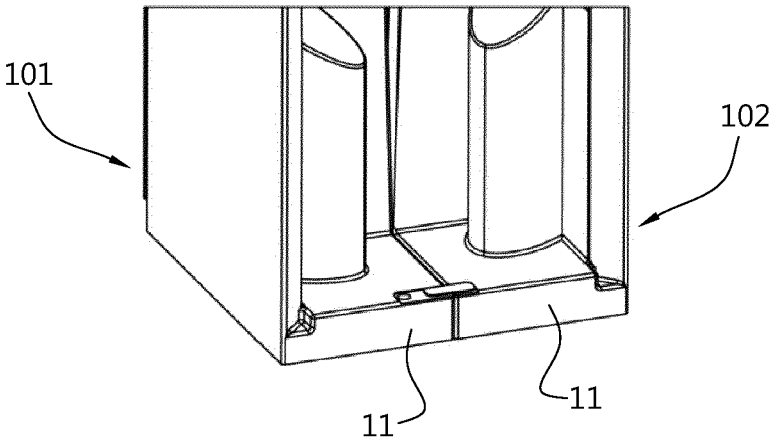
Figure 27:
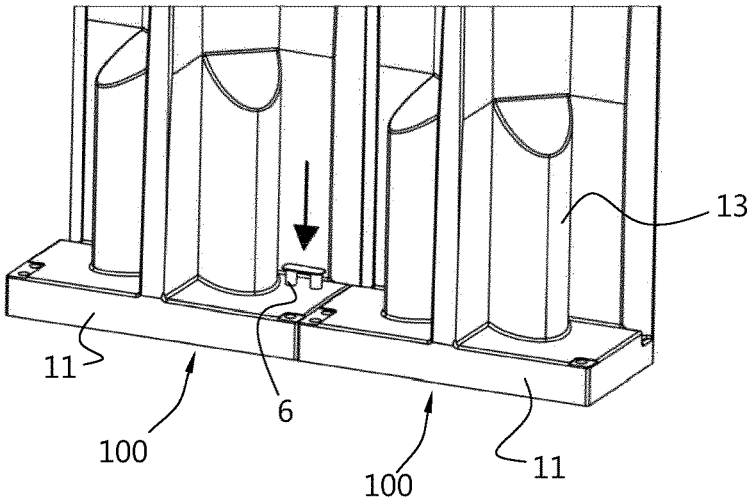

FIG. 24 shows a U-shaped connector 6 in a perspective view. The connector 6 is a separate item of an embodiment of the urinal unit according to the invention. The connector 6 has a connector body 60 including a first and second pin-shaped member 61, 62. The connector is adapted to connect adjacently positioned urinal units, in particular to connect adjacently positioned base platforms 11, as shown in FIGS. 25 and 26. Use of the connector 6 may be beneficial to increase stability of combined urinal units in a bottom region BR of the transport assembly TA, as for example shown in FIG. 22. Together with the pair of lock members 5 at the top region of the transport assembly, the at least one connector 6 at the bottom region may prevent any lateral displacement of urinal units. Besides increasing stability of stacked urinal units, the connector 6 may be further beneficial in normal use in connecting base platforms 11 of multiple side-by-side arranged urinal units, as shown in FIG. 27.

Figure 28:
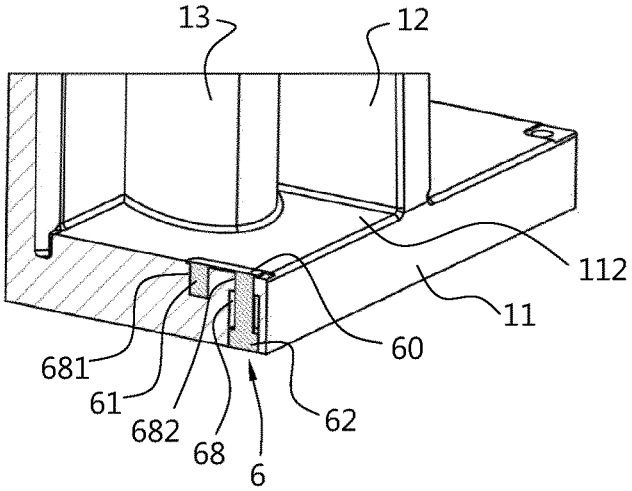
Figure 29:
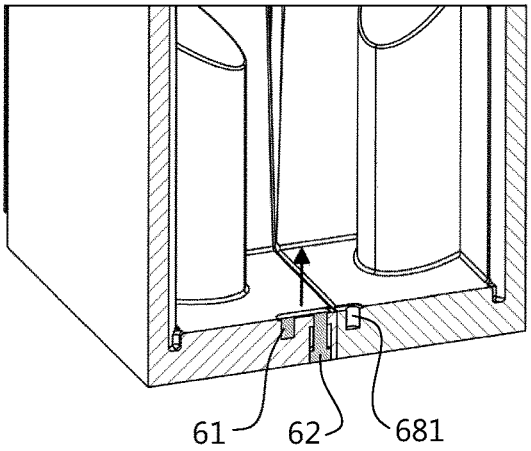

FIG. 28 shows in a cross-sectional view an alternative embodiment of the U-shaped connector 6 which is positioned at a corner position of the base platform 11. Here, the connector 6 is axially movable, but non-releasable connected to the urinal unit. The connector 6 has a connector body 60 comprising a first and second pin shaped member 61, 62. The connector body 60 is plate-shaped. The second pin shaped member 62 is analogous to the above-described non-releasable pin 57 provided with a narrow section. The second pin-shaped member 62 has an enlarged extended portion 621. The extended portion 621 has an enlarged diameter. The second pin-shaped member 62 has a narrowing in between the plate shaped connector body 60 and the extended portion 621. The pin-shaped first and second member 61, 62 are respectively received in a first and second hole 681, 682. The second hole 682 includes a narrow section. Here, the second hole 682 is a through hole which extends through the base platform 11. The first hole 681 is a blind hole. In the shown assembly, the narrow section of the second hole 682 is positioned in between the extended portion 621 and the plate shaped connector body 60. The narrowing of the second pin-shaped member extends over a larger distance in the axial direction than the narrow section 681 such that the second pin-shaped member is axially movable. The connector 6 is axially movable about a distance, but the extended portion 621 prevents a complete removal.

Figure 30:
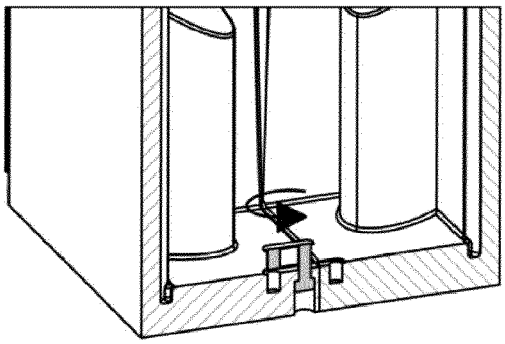
Figure 31:
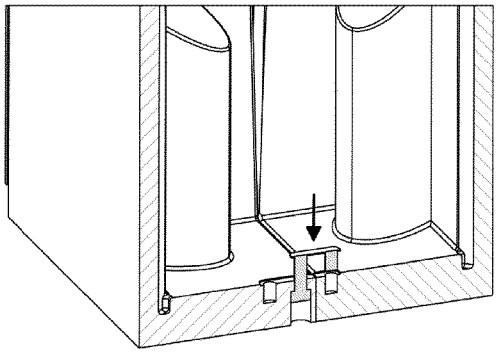
Figure 32:
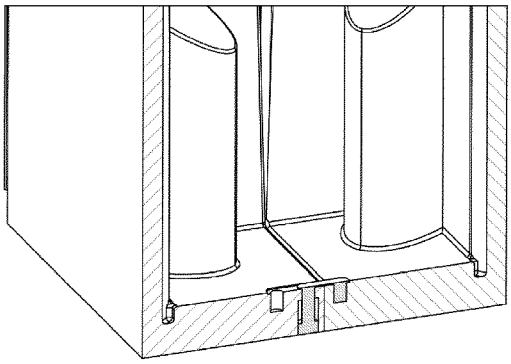

FIG. 29-32 show in successive views operational steps for using the connector 6 to connect two adjacent positioned urinal units 1. In a first step of a method for connecting urinal units, the non-releasable connector 6 is moved in the axial direction as indicated by the arrow. The connector 6 is lifted. The first pin-shaped member 61 is lifted out of the first whole 681. Hereafter, as shown in FIG. 30, the connector 6 is rotated. The second member 62 is tubular which allows a rotation of the connector 6. The first member 61 is rotated to a first hole of the adjacent urinal unit as shown in FIG. 31. Subsequently, as shown in FIG. 32, the connector is lowered, such that the first member 61 is inserted into the first hole 681 of the adjacent urinal unit. Herewith, the two urinal units are easily connected. In the method for connecting or disconnecting urinal units, the connector 6 is not separated from the unit body which beneficially prevents a loosening of the connector.

Numerous variants are possible in addition to the embodiments shown in the figures.

Figure 34:
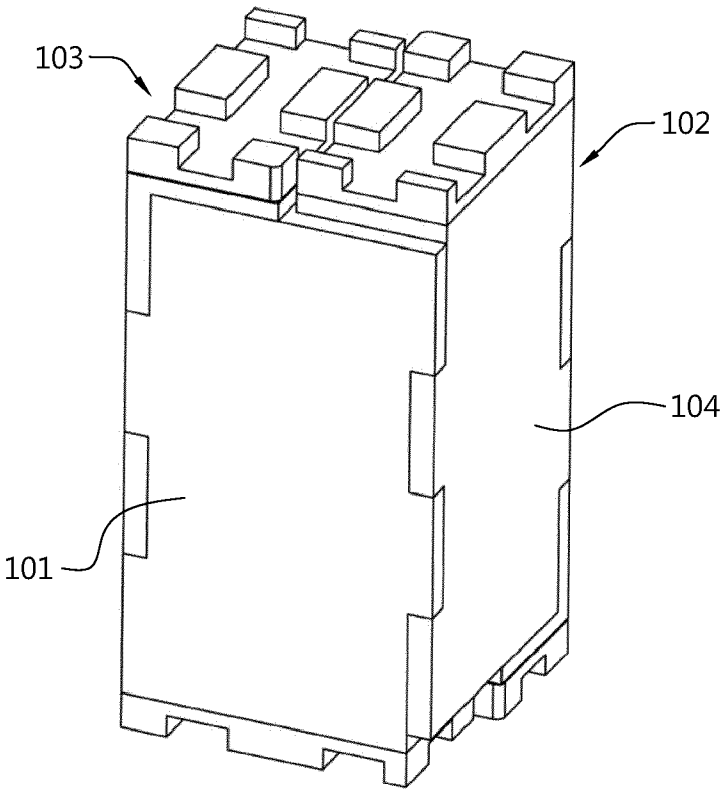
Figure 33:
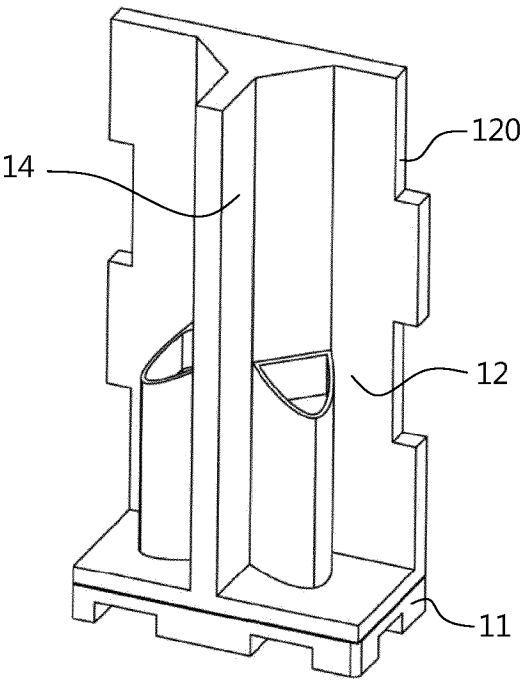

In a variant of the illustrated embodiment of the combined four urinal units as shown in FIGS. 9-13 in which each urinal unit has an upstanding wall provided with chamfered side edges, in an alternative embodiment, this feature of chamfered side edges may be substituted by recessed side edges as shown in FIGS. 33 and 34. Here, the side edges 120 of the upstanding wall 12 have a regular pattern of at least one recess. When placing a urinal unit upside down, this urinal unit fits to an upstanding urinal unit as shown in FIG. 34.

In a variant, the transport assembly TA may be obtained by stacking an upside down oriented urinal unit onto an urinal unit which stands on an underground. It is apparent that in an equivalent way, the transport assembly TA may be obtained by stacking urinal units laying down on an underground in which one urinal unit is in an upside down orientation with respect to the other urinal unit.

As shown in FIGS. 8B-8D, in a variant on the embodiment shown in FIG. 9, the upstanding wall 12 may be formed by a collapsible upstanding wall to reduce a height of the urinal unit before combining four urinal units together to obtain the transport assembly.

Although the first aspect of the present invention has been described in detail with reference to FIGS. 1-33, it will be apparent to those skilled in the art that various changes and modifications can be made without departing from the scope of the invention as hereinafter claimed. It is intended that all such changes and modifications be encompassed within the scope of the present disclosure and claims.

It is remarked that aspects and facets according to the invention and in particular mentioned in the dependent claims are considered patentable as such. The features mentioned to define aspects and faces are considered patentable independent of other features.

Thus, according to the first aspect, the invention provides a urinal unit and transport method for temporary providing an urinal comprising a L-shaped unit body with a base platform which forms a pedestal to stand in front of a urinal and an upstanding wall which forms a privacy separation. At least one urinal is connected to a front side of the upstanding wall. The urinal unit comprises a pair of a male and a female lock member to engage with each other in a transport assembly of an assembly of urinal units. In the transport assembly one of the urinal units is stacked in an upside down orientation onto another urinal unit in which the lock members engage with each other to provide stability. The transport assembly may be further compacted by collapsing the upstanding wall of each urinal unit.

FIGS. 35-51 relate in particular to the second aspect of the invention. Identical reference signs are used in the drawings 35-51 to indicate identical or functionally similar components. Specific features may also be considered apart from the shown embodiment and may be taken into account in a broader context as a delimiting feature, not only for the shown embodiment but as a common feature for all embodiments falling within the scope of the appended claims.

Figure 35:
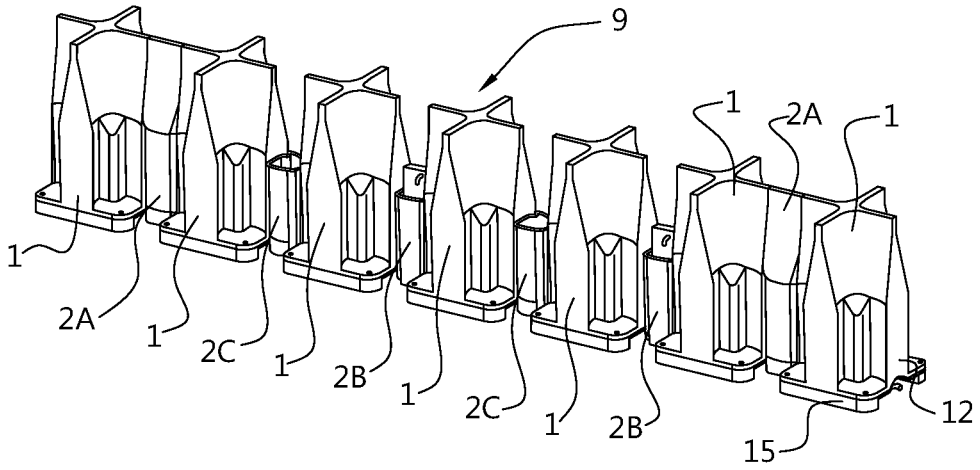

FIG. 35 shows in a perspective view an embodiment of the sanitation system 9 according to the invention. The sanitation system 9 is configured to temporary provide at least one urinal. The sanitation system is a robust system and adapted to be placed at an outdoor terrain at public events, like a music or sports event. The sanitation system 9 is typically a rental product which can be hired by an event organisation to provide a sanitary provision for a large crowd.

Figure 36:
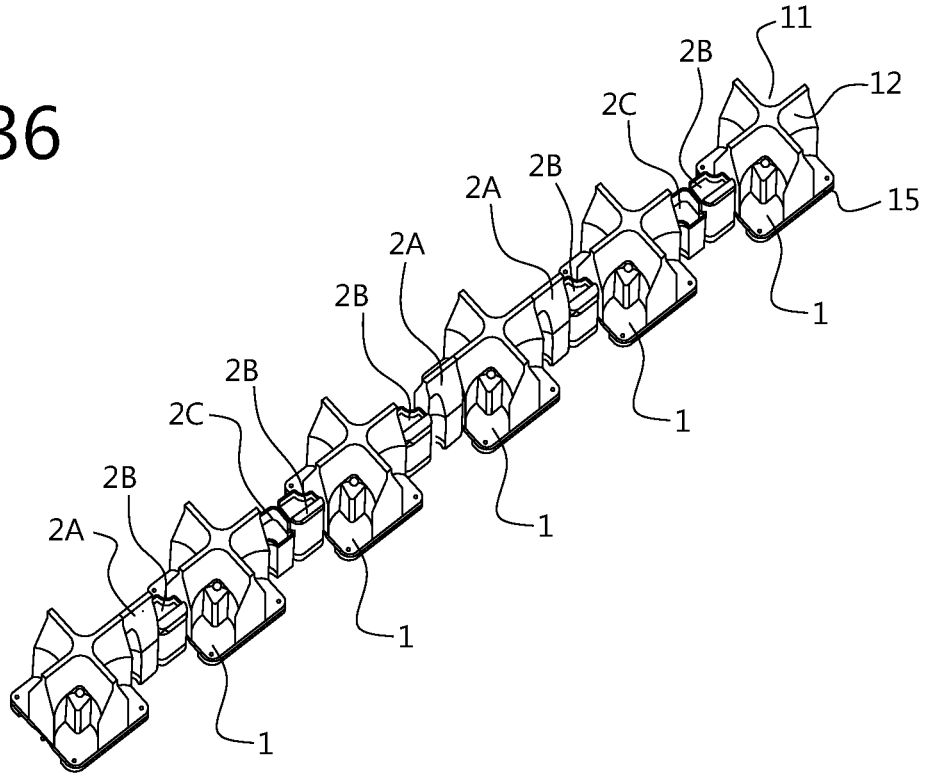

As shown in FIGS. 35 and 36, the sanitation system 9 is formed by a plurality of urinal units 1 and urinal unit accessories 2. Here, the urinal units 1 and the urinal unit accessories 2A, 2B, 2C are together positioned in an array. A variety of arrangements is possible. One or more urinal unit accessories 2 can be placed in between a pair of urinal units. The urinal unit accessories 2 are of different types.

FIG. 37, 38-40 respectively show the urinal unit 1 and some different types of urinal unit accessories 2. Here, a reservoir 2A, a hand wash station 2B and a garbage bin 2C are depicted, but other types of urinal unit accessories are also conceivable, e.g. a coat rack, a cable cover etc. A urinal unit accessory 2 is an accessory which is configured to be used in combination with the urinal unit 1. The reservoir 2A may form an external tank to the urinal unit to increase a storage capacity of the urinal unit. The hand wash station 2B is to be used in combination with the urinal unit 1 to allow a user to wash his hands after visiting the urinal unit 1. The garbage bin 2C is to be used in combination with the urinal unit 1 and the hand wash station 2B to allow a user to put away a paper for drying hands.

Figure 37:
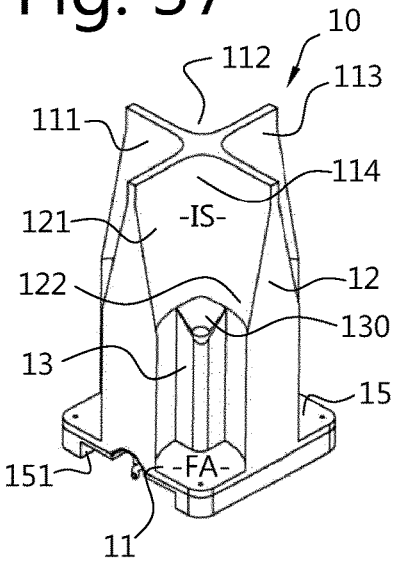

FIG. 37 shows an urinal unit 1 which has a unit body 10. The unit body 10 has a first, second, third and fourth urinal compartment 111, 112, 113, 114. The urinal compartments 11 are equally arranged around a circumference of the unit body 10.

Each urinal compartment 11 is formed by a pair of opposite positioned sidewalls 121, 122 of an upstanding wall 12. Seen from above, the upstanding wall 12 has a cross-shape. A urinal compartment 11 is provided at each corner of the unit body 10. Each urinal compartment 11 has an entrance at a rear side which entrance may have a door but which entrance is preferably free and open from outside to allow a user without any burden to step into the urinal compartment. The sidewalls 121, 122 of the upstanding wall 12 delimit an inner space IS which forms the urinal compartment 11. These sidewalls 121, 122 provide privacy to a user when standing in front of an urinal 13 at a front side of the urinal compartment 11.

The unit body 10 has an upper portion formed by the upstanding wall 12 which is manufactured as a one-piece item, e.g. by moulding. Preferably, the upper portion of the unit body 10 is made by rotation moulding, in particular from a plastic material, e.g. HDPE. The upstanding wall 12 provides privacy to a user in the urinal compartment 11. The upstanding wall 12 extends in a height direction from a platform 15. Preferably, the upstanding wall 12 has a height of at least 1.5 m. Preferably, the upstanding wall 12 and at least an upper portion of the platform 15 are made as a one-piece item. The one-piece item is beneficial in that it provides a robust structure which may prevent damage by vandalism.

The platform 15 has a rectangular, in particular square, shape. The platform 15 forms a pedestal for a user to stand in front of the urinal 13. The platform 15 provides a stable base to the unit body 10 which is beneficial in an outdoor environment which may have a rough or muddy underground. Forklift openings 151 are provided at a bottom side of the platform 15 which allow the unit body 10 to be easily displaced by a forklift truck.

Further, the upstanding wall 12 has an internal volume which forms an internal reservoir. The upstanding wall 12 may have a constant wall thickness, such that a hollow inner space results forming the internal reservoir. The internal reservoir is centrally positioned in between the surrounding urinals 13. The internal reservoir is positioned at a central region of the platform 15. The internal reservoir is in fluid communication with the at least one urinal 13 and has a capacity for storing urine.

Figure 38:
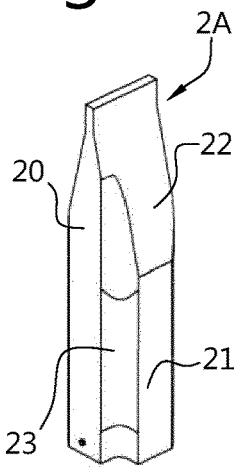

FIG. 38 shows an urinal unit accessory 2 which has an accessory body 20 which is here configured as a reservoir 2A, also called a waste tank, for collecting urine from the urinal unit 1. The reservoir 2A has a hollow accessory body 20. The reservoir is configured to be placed adjacent to the unit body 10 of the urinal unit 1. The reservoir has an oblong shape. The reservoir has a block-shaped lower portion 21 and a bevelled, in particular roof shaped, upper portion 22. Although the reservoir has a relative small footprint and a relative height centre of gravity, a stable arrangement is obtained due to the combination of the urinal unit 1 and the reservoir. The urinal unit 1 supports the reservoir in a lateral direction.

Figure 39:
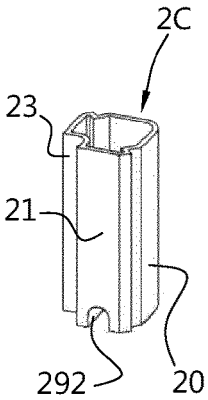

FIG. 39 shows an urinal unit accessory 2 which has an accessory body 20 which is here configured as a garbage bin 2C. The garbage bin 2C has a hollow block-shaped accessory body 20 which is adapted for collecting garbage, like tissues etc. In a longitudinal section, the garbage bin has a shape which corresponds with the shape of an outer side face of the upstanding wall 12. Herewith, the garbage bin has an outer shape which can be aligned with the upstanding wall of the urinal unit 1.

Figure 40:
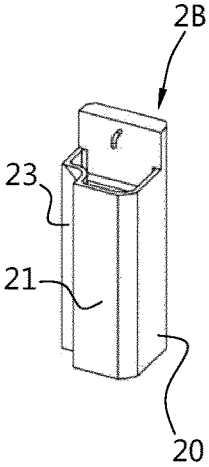

FIG. 40 shows an urinal unit accessory 2 which has an accessory body 20 which is here configured as a handwash station 2B. At an upper region, the handwash station 2B has a sink and a water tap. At a lower region, the handwash station may have a foot pedal to operate the water tap.

Figure 47:
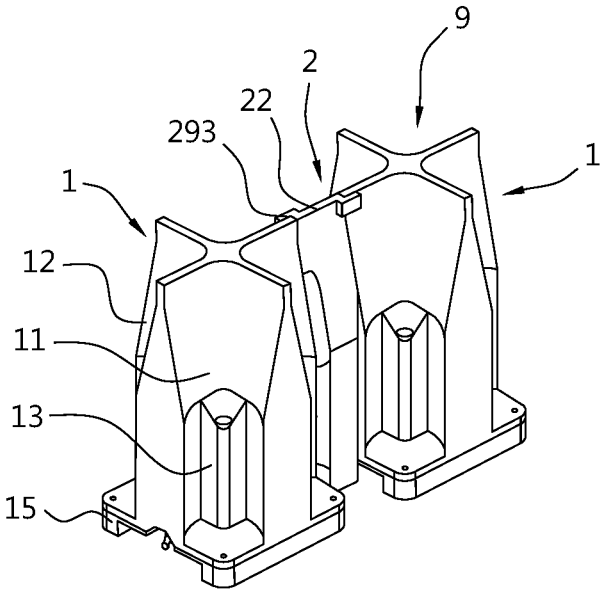

The urinal unit accessories 2 as illustrated in FIGS. 38-40 have some features in common. All accessory unit bodies 20 have a block-shaped lower portion 21. This lower portion 21 is sized in correspondence with a lower portion of the upstanding wall 12 of the unit body 10, such that each urinal unit accessory 2 can be aligned with each other and with the urinal unit 1 as shown in FIGS. 34 and 35. In FIGS. 34 and 47, only a single urinal unit accessory 2 is positioned in between 2 urinal units 1, but it is of course conceivable that an array of sanitation systems can be arranged in which each urinal unit 1 is combined with a reservoir, a hand wash station (as in FIG. 36) and/or a garbage bin. As shown in the FIG. 36, for example, in between two urinal units 1, a reservoir 2A, a hand wash station 2B and a garbage bin 2C can be arranged. The modularity of the sanitation system 9 allows a high variety of arrangements. Preferably, in each arrangement, a urinal unit 1 is at least combined with a reservoir 2A, such that each urinal unit 1 has its own reservoir.

FIG. 41-45 illustrate a major benefit provided by the sanitation system 9 according to an aspect of the invention is that each urinal unit accessory 2 fits in a urinal compartment 11 of the unit body 10 of the urinal unit 1 to obtain a transport assembly TA.

As also shown in FIGS. 38-40, each urinal unit accessory 2 has an accessory body 20 which is provided with a urinal recess 23. The urinal recess 23 is adapted for receiving the urinal 13 in the urinal compartment. The urinal recess 23 extends in a longitudinal direction from a bottom face about a distance at least equal to a height of the urinal 13 of the unit body 10, such that the urinal recess 23 fits over the urinal 13. In particular, the urinal recess 23 extends along the whole length of the accessory body 20 as shown in FIGS. 39 and 40.

Figure 41:
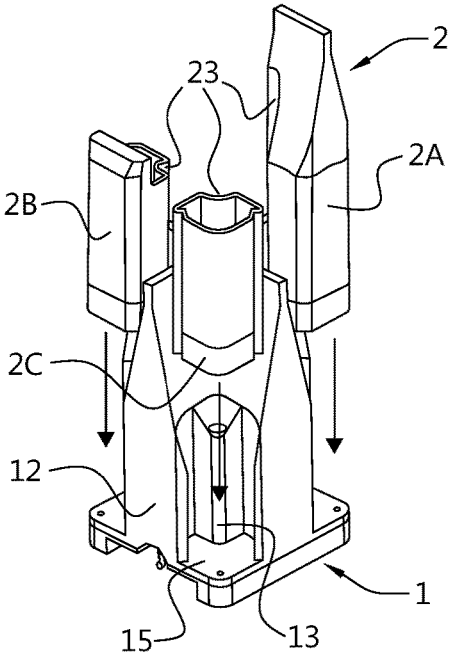

As shown in FIG. 41, when inserting the urinal unit accessory 2 into the urinal compartment 11, the urinal recess 23 is aligned with the urinal 13. In the transport assembly TA, when the urinal unit accessory 2 is placed in the urinal compartment 11, the urinal recess 23 is facing the urinal 13.

Figure 42:
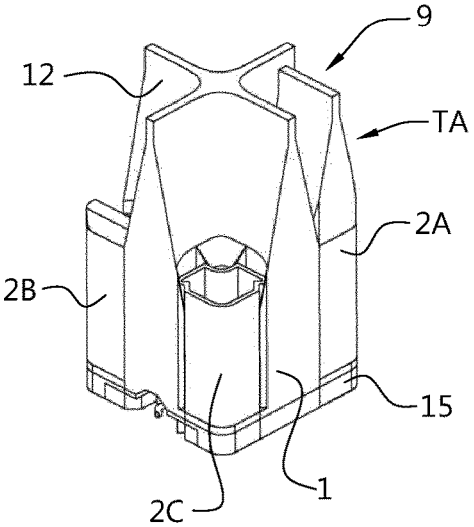
Figure 43:
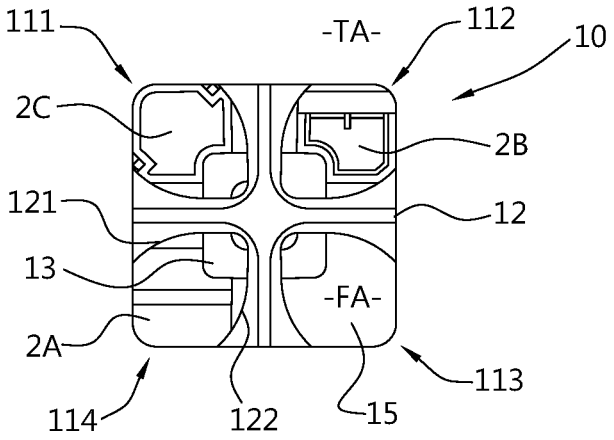

FIG. 41-43 show how the urinal unit accessories 2 fit into the urinal compartments 11 of the unit body 10 of the urinal unit 1. The urinal unit accessories 2 are placed from above into the urinal compartments 11 to obtain a transport assembly TA. In the transport assembly TA, the at least one urinal unit accessory 2 is packed onto the urinal unit 1. The urinal unit accessories 2 are lowered—as indicated by the arrows in FIG. 40—into the urinal compartments 11. After inserting the urinal unit accessory 2 into a urinal compartment 11, the urinal unit accessory 2 is supported by a floor area of the urinal compartment 11. The shape of each lower portion of each urinal unit accessory 2 substantially equals an inner shape of a lower region of each urinal compartment 11. Here, the footprint of each urinal unit accessory 2 substantially equals the floor area of the urinal compartment 11.

Advantageously, the packaging of the at least one urinal unit accessory 2 into a urinal compartment 11 provides a very compact configuration of the sanitation system 9 which is beneficial in transport. In addition, the corresponding shapes of the urinal unit accessory 2 and the inner shape of the urinal compartment 11 provides a maximum volume available to the urinal unit accessory 2 for storing or collecting water or other materials.

Figure 44:
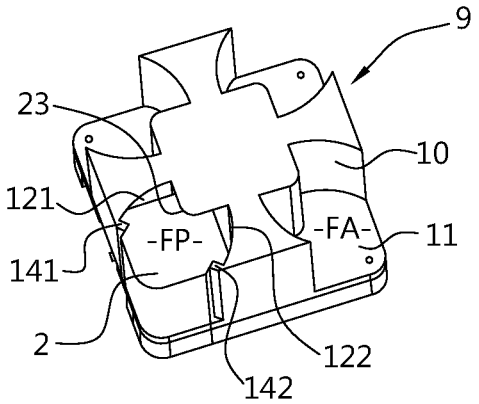
Figure 45:
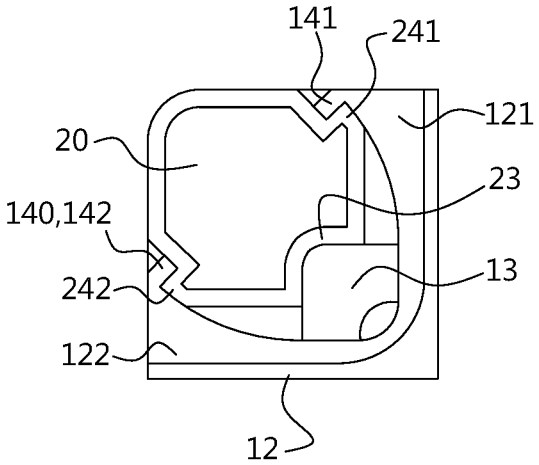

FIGS. 44 and 45 show a cross-sectional view across a lower portion of the sanitation system 9. The urinal unit accessory 2 is placed on a floor area of an urinal compartment 11. The urinal unit accessory 2 has an accessory body 20 which has a rectangular, in particular square, cross-section. The urinal recess 23 is positioned at a first corner of the accessory body 20. The remaining corners of the accessory body 20 are rounded. The accessory body 20 has an outer circumferential side which is sized to fit in between the urinal 13 and the left and right side wall 121, 122 forming the inner compartment 11.

FIGS. 43-45 show a further improvement in which at least one lock member 14, 24 is provided for locking the urinal unit accessory 2 to the urinal unit 1. The lock member 14, 24 prevent the urinal unit accessory 2 from falling sidewards out of the urinal compartment 11. The at least one lock member 14, 24 is beneficial in that additional tooling, e.g. a tension strap, to keep the urinal unit accessory 2 in the urinal compartment 11 is superfluous. Due to the at least one lock member 14, 24, the urinal unit accessory to is stably placed in the urinal compartment of the urinal unit 1.

As shown in FIG. 43, the urinal unit accessory 2 fits by a form closure inside the urinal compartment. The form closure is provided by a compartment lock member 14. The compartment lock member 14 is integrally formed with a side wall of the urinal compartment 11. Here, as shown in FIG. 44, both sidewalls 121, 122 are each provided with respectively a first compartment lock member 141 and a second compartment lock member 142.

As shown in FIG. 45, the form closure can be provided by a compartment lock member 14 of the unit body 10 which cooperates with an accessory lock member 24 of the urinal unit accessory 2. The compartment lock member 14 and the accessory lock member 24 are complementary shaped. The compartment lock member 14 and the accessory lock member 24 together form a pair of a male and a female locking member.

Here, the compartment lock member 14 is formed as a male member by a lock ridge 140 which extends along the upstanding wall 12 in height direction. The compartment lock member 14 is integrally shaped with the unit body 10. Both the left and the ride side wall 121, 122 are each provided with such a compartment lock member 141, 142.

The accessory lock member 24 is positioned at a corner neighbouring the recessed corner of the accessory body 20. Two opposing corners of the accessory body 20 are provided with an accessory lock member 241, 242. Here, the accessory lock member 24 is a female lock member which is formed by a lock recess 241, 242 extending in a longitudinal direction of the accessory body 20. The accessory lock member 24 is integral shaped with the accessory body 20.

Figure 46:
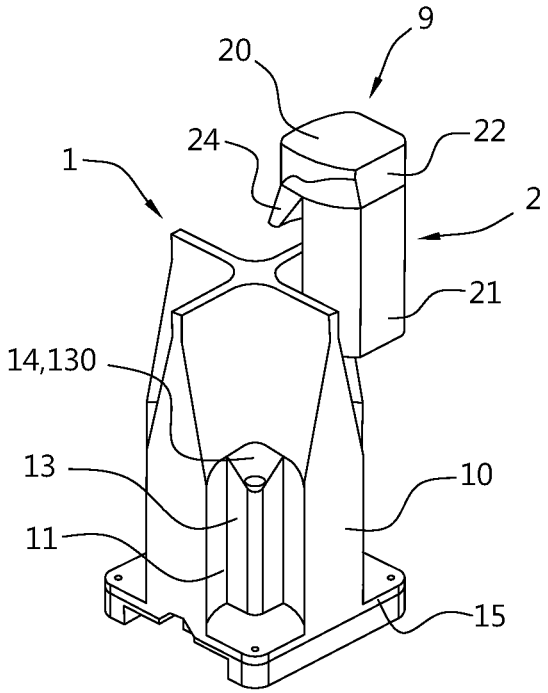

FIG. 46 shows an alternative embodiment of the urinal unit 1. The urinal 13 has a urinal bowl opening 130 which functions as a compartment lock member 14. The urinal unit accessory 2 has an accessory body 20 which fits inside the urinal compartment 11. Here, the urinal unit accessory 2 is further provided with an accessory lock member 24. The accessory lock member 24 is formed as a male member. The accessory lock member 24 is downwardly protruding from an upper portion 22 of the accessory body 20. When inserting the urinal unit accessory to into the urinal compartment 11 by a downwardly directed movement, the accessory lock member 24 enters the urinal bowl opening 130. By receiving the accessory lock member 24 in the urinal bowl opening 130, the urinal unit accessory 2 becomes locked in a lateral direction.

FIGS. 47-51 show in further detail a combination of a reservoir 2A as shown in FIG. 38 and at least one urinal unit 1 as shown in FIG. 37. The reservoir 2A is positioned in between a first and second urinal unit 1. The reservoir 2A is positioned in an upright position and in an abutting engagement with a left sided positioned urinal unit and a right sided positioned urinal unit.

The reservoir 2A has a same height as the urinal unit 1. At the upper portion 22, the reservoir 2A is coupled by a reservoir coupling member 293 to an adjacent urinal unit 1. The reservoir 2A is provided with a left and right coupling member 293. Each coupling member 293 is laterally protruding from the upper portion 22 of the reservoir.

Here, a plate shaped coupling member 293 is respectively positioned at a front and back side for interlocking the reservoir in between two neighbouring unit bodies. Each coupling member 293 engages to an adjacent upstanding wall 12 of a unit body.

Other embodiments of the coupling member 293 are conceivable, e.g. a U-shaped coupling member, to engage with an adjacent unit body. Herewith, the reservoir is stabilised in between the neighbouring unit bodies.

The reservoir 2A has an outer shape which can be aligned with the upstanding wall 12 of the urinal unit 1. In a longitudinal section, the reservoir has a shape which corresponds with a shape of an outer side face of the upstanding wall 12. As the upstanding wall 12, an upper region of the reservoir is also inclined, and a lower region of the reservoir is block-shaped. Herewith, the reservoir can be aligned with the upstanding wall 12 of the urinal unit 1. The reservoir 2A contributes to an increase in privacy by creating a privacy shield together with a side wall 121 of the urinal unit.

Preferably, the reservoir 2A is mechanically connectable to the urinal unit 1. A connector element may be positioned at the top portion of the reservoir to connect the reservoir to the top portion of the upstanding wall 12.

Figure 48:
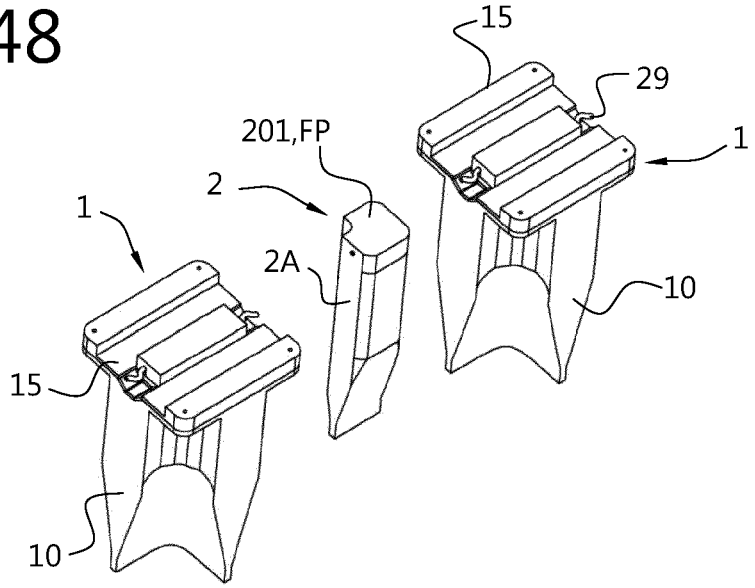
Figure 49:
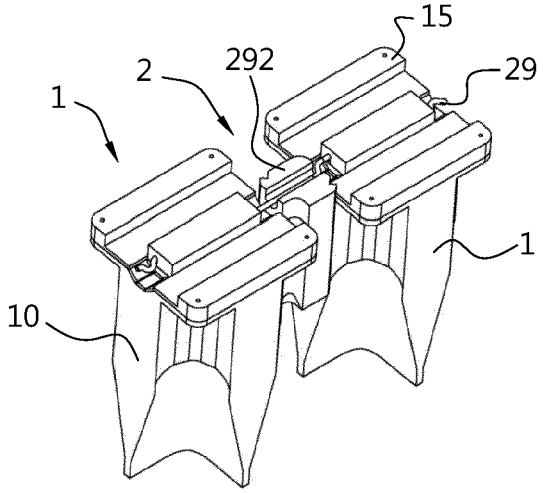

FIGS. 48 and 49 show the combination of FIG. 47 in a bottom view. The reservoir 2A is a modular item of the sanitation system 9 which is connectable in fluid communication with the urinal unit by a conduit, in particular a drain hose 29. The drain hose 29 is a flexible conduit which may prevent connection failures due to movements of the sanitation system during use. One end of the drain hose 29 is connectable at one side to the unit body 10, in particular to the platform 15. The other end of the drain hose 29 is connectable to a bottom region of the reservoir 2A. Herewith, the externally positioned reservoir 2A is fluidly connectable to an internal reservoir of the unit body 10 to increase a total storage capacity of the sanitation system 9.

Figure 50:
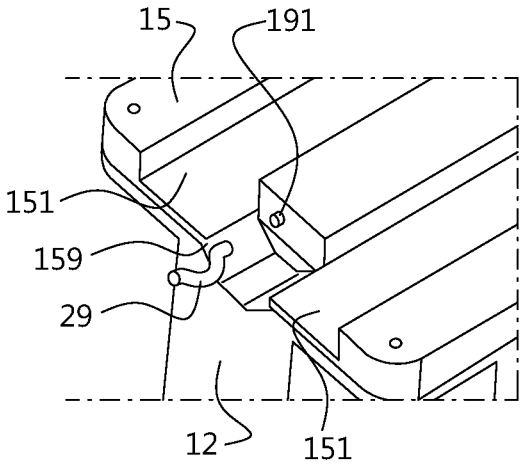

FIG. 50 shows an enlarged view of the drain hose 29 connectable to the platform 15 of the urinal unit 1. In between the forklift openings 151, the platform has a drain outlet 191 for draining stored liquid. The drain outlet 191 is situated in a drain recess 159. The drain outlet 191 is spaced at a distance from a side face of the upstanding wall 12, such that drain outlet 191 is positioned at a shielded place to prevent damage. Preferably, the drain outlet 191 comprises a valve which is openable by an insertion of the drain hose.

Figure 51:
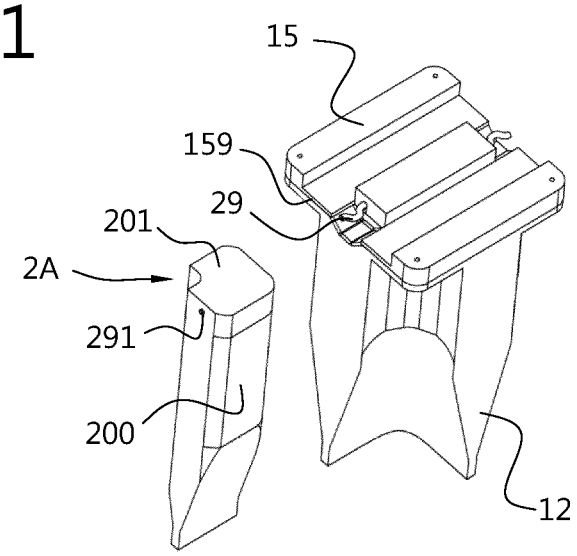

FIG. 51 shows a connection of the reservoir 2A to the urinal unit 1 by connecting the drain hose 191 to a reservoir port 291. The reservoir port 291 is positioned close to a bottom face 201 of the reservoir. Preferably, the reservoir port 291 comprises a valve which is openable by an insertion of the drain hose. A disconnection of the drain hose 29 from either the drain outlet 191 or the reservoir port closes the valve to prevent spilling liquid. Herewith, the external reservoir 2A is connectable to the internal reservoir 19 of the urinal unit 1 according to the principle of communicating vessels. A liquid balances out to the same level in both containers provided by the internal and external reservoir 191,2A.

Summarised, as illustrated in FIG. 42, according to the second aspect of the invention, a sanitation system 9 and a method for transporting such a sanitation system comprising an urinal unit 1 which has a unit body 10 having at least one urinal compartment 11 and at least one urinal unit accessory 2 which has an accessory body 20. An outer shape of the accessory body 20 is adapted to an inner shape of the inner compartment 11 of the unit body 10. A close fit between the urinal unit accessory and the inner compartment of the unit body is obtainable to provide a stable transport assembly. Preferably, the urinal unit is provided with a compartment lock member 14 and the urinal unit accessory is provided with a cooperating accessory lock member 24.

Numerous variants are possible in addition to the embodiments shown in FIGS. 35-51. In a variant of the illustrated embodiment of the urinal unit, the urinal unit may have only two or six urinal compartments instead of the four illustrated.

Thus, according to the second aspect, the invention provides a sanitation system and a method for transporting such a sanitation system comprising an urinal unit which has a unit body having at least one urinal compartment and at least one urinal unit accessory which has an accessory body. An outer shape of the accessory body is adapted to an inner shape of the inner compartment of the unit body. A close fit between the urinal unit accessory and the inner compartment of the unit body is obtainable to provide a stable transport assembly. Preferably, the urinal unit is provided with a compartment lock member and the urinal unit accessory is provided with a cooperating accessory lock member.

Although the present invention has been described in detail, it will be apparent to those skilled in the art that various combinations, changes and modifications can be made without departing from the scope of the invention as hereinafter claimed. It is intended that all such combinations, changes and modifications be encompassed within the scope of the present disclosure and claims. Aspects and facets which are disclosed in the above are disclosed independently of other described features and are considered to define patentable subject matter on its own merits without a combination of those features or in a technical practical sense with any of these features to define an improved embodiment.

Reference signs list regarding FIGS. 1-34:

| | |
|---|---|
| F front | TA transport assembly |
| B back | 100 urinal unit |
| L left | 101 first urinal unit |
| R right | 102 second urinal unit |
| BR bottom region | 103 third urinal unit |
| TR top region | 104 fourth urinal unit |
| 1 unit body | 142 lower portion end face |
| 11 base platform; pedestal | 143 upper portion frontal surface |
| 110 foot | 5 pair of lock members |
| 111 opening | 51 male lock member |
| 112 base platform top surface | 52 female lock member |
| 113 base platform frontal surface | 53 protrusion |
| 12 upstanding wall; privacy separation | 54 recess |
| 120 upstanding wall side edge | 55 clearance |
| 122 upstanding wall top surface | 57 pin |
| 123 upstanding wall lower portion | |

-continued

| | |
|---|---|
| 124 upstanding wall upper portion | 570 pin body |
| 13 urinal | 571 pin head |
| 131 left urinal | 572 pin base |
| 132 right urinal | 573 narrowed section |
| 14 privacy partition | 58 aperture |
| 140 upper portion | 6 connector |
| 141 lower portion | 60 U-shaped connector |
| | 61 first pin-shaped connector member |
| | 62 second pin-shaped connector member |
| | 621 extended portion |

Reference signs list regarding FIGS. 35-51:

| | |
|---|---|
| TA transport assembly | 10 unit body |
| IS inner space | 11 urinal compartment |
| FA floor area | 111 first urinal compartment |
| FP footprint | 112 second urinal compartment |
| 9 sanitation system | 113 third urinal compartment |
| 1 urinal unit | 114 fourth urinal compartment |
| 12 upstanding wall | 2A reservoir |
| 121 left sidewall | 2B hand wash station |
| 122 right side wall | 2C garbage bin |
| 13 urinal | 20 accessory body |
| 130 urinal bowl opening | 201 bottom face |
| 14 compartment lock member | 21 lower portion |
| 140 lock ridge | 22 upper portion |
| 141 first compartment lock member | 23 urinal recess |
| 142 second compartment lock member | 24 accessory lock member |
| 15 platform | 240 outer rounding |
| 151 forklift opening | 241 lock recess |
| 159 drain recess | 29 drain hose |
| 19 internal reservoir | 291 reservoir port |
| 191 drain outlet | 292 conduit cover |
| 2 urinal unit accessory | |

The invention claimed is:

1. A urinal unit configured to provide at least one urinal on a temporary basis in an environment, wherein the urinal unit comprises a L-shaped unit body, wherein the unit body comprises;

a base platform at a bottom region of the unit body which base platform forms a pedestal for a user to stand in front of the at least one urinal; and an upstanding wall at a back region of the unit body which upstanding wall forms a privacy separation from the environment;

wherein the at least one urinal is connected to a front side of the upstanding wall, wherein the urinal unit further comprises a pair of a male lock member and a female lock member which are complementary shaped to each other to engage with each other in a transport assembly of a plurality of urinal units, and wherein, in the transport assembly, a first urinal unit of the at least at least one urinal unit is stacked in an upside down orientation onto a second urinal unit in which the male and female lock members of the stacked urinal units engage with each other.

2. The urinal unit according to claim 1, wherein the male lock member is formed by an upwardly directed protrusion and the female lock member is formed by a recess which is complementary shaped to the protrusion for receiving said protrusion in the transport assembly to prevent a relative movement of the urinal units in a lateral direction.

3. The urinal unit according to claim 1, wherein one of the male or female lock member is positioned on a top surface of the upstanding wall, and wherein the complementary other female or male lock member is positioned at a top surface of the base platform, such that said male and female lock members engage to each other when the first urinal unit is placed upside down on top of the second urinal unit.

4. The urinal unit according to claim 3, wherein two lock members are positioned at a distance from each other on the top surface of the upstanding wall.

5. The urinal unit according to claim 1, wherein the urinal unit has at least two urinals at the front side of the upstanding wall, wherein a wall portion forming a privacy partition is positioned in between each urinal.

6. The urinal unit according to claim 5, wherein both the male and female lock member are positioned on an end face of said wall portion in between two urinals.

7. The urinal unit according to claim 1, wherein the male lock member is a separate item.

8. The urinal unit according to claim 7, wherein the male lock member is axially adjustably connected to the unit body.

9. The urinal unit according to claim 8, wherein the male lock member is fixedly connected to the unit body.

10. The urinal unit according to claim 1, wherein the upstanding wall has an upstanding wall upper portion and an upstanding wall lower portion, wherein the upstanding wall upper portion is configured to be lowered relative to the upstanding wall lower portion to obtain a compact configuration.

11. The urinal unit according to claim 1, wherein the transport assembly of urinal units is a 2-unit assembly which is formed by the first urinal unit in an upstanding orientation and the second urinal unit in stacked upside down orientation.

12. The urinal unit according to claim 1, wherein the transport assembly of urinal units is a 4-unit assembly which is formed by the first urinal unit, the second urinal unit, a third urinal unit and a fourth urinal unit, wherein the first and second urinal units are placed opposite each other and are facing each other, and wherein the third and fourth urinal units are stacked onto the first and second urinal units in an upside down orientation.

13. The urinal unit according to claim 12, wherein the upstanding wall of each urinal unit has chamfered side edges for fitting the third and fourth urinal units in between the first and second urinal unit.

14. The urinal unit according to claim 1, wherein the urinal unit further comprises a connector for connecting adjacently positioned urinal units.

15. The urinal unit according to claim 14, wherein the connector comprises a U-shaped connector body comprising a first pin-shaped connector member and a second pin-shaped connector member, wherein the second pin-shaped member is longer than the first pin-shaped member and is fixedly connected to the unit body.

16. A sanitation system comprising a plurality of urinal units according to claim 1.

17. A restroom area for providing a sanitary facility for a public comprising a sanitation system according to claim 16, wherein a sanitary wall is arranged in which at least two urinal units are arranged in an array.

18. A method for transporting a plurality of urinal units comprising the steps of:

providing at least two urinal units according to claim 1 in which each urinal unit comprises an L-shaped unit body;

orienting a first urinal unit in a stand-up orientation;

orienting a second urinal unit in an upside down orientation with respect to the first urinal unit, such that the L-shaped unit bodies are facing each other; and stacking the second urinal unit onto the first urinal unit to obtain a transport assembly of said urinal units.

19. The method according to claim 18, wherein the method comprises a step of combining two or four urinal units to obtain respectively a 2-unit or 4-unit transport assembly.

* * * * *